US009208639B2

(12) United States Patent
Gagner et al.

(10) Patent No.: US 9,208,639 B2
(45) Date of Patent: Dec. 8, 2015

(54) HANDHELD DEVICES FOR COMMUNITY EVENTS OF WAGERING GAMES

(71) Applicant: WMS Gaming, Inc., Waukegan, IL (US)

(72) Inventors: Mark B. Gagner, West Chicago, IL (US); Benjamin T. Gomez, Chicago, IL (US); Sean P. Kelly, Chicago, IL (US); Timothy C. Loose, Chicago, IL (US); Scott A. Massing, Lincolnwood, IL (US); Pamela S. Smith, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 246 days.

(21) Appl. No.: 13/804,667

(22) Filed: Mar. 14, 2013

(65) Prior Publication Data

US 2013/0274016 A1 Oct. 17, 2013

Related U.S. Application Data

(60) Provisional application No. 61/623,917, filed on Apr. 13, 2012.

(51) Int. Cl.
*G07F 17/32* (2006.01)

(52) U.S. Cl.
CPC ..... *G07F 17/3211* (2013.01); *G07F 17/3218* (2013.01); *G07F 17/3272* (2013.01)

(58) Field of Classification Search
CPC ..... G07F 17/3211; G07F 17/3218; G07F 17/3272
USPC ..... 463/34, 20
See application file for complete search history.

(56) References Cited

U.S. PATENT DOCUMENTS

| | | | | |
|---|---|---|---|---|
| 5,779,544 | A * | 7/1998 | Seelig et al. | 463/6 |
| 2002/0068631 | A1 | 6/2002 | Raverdy et al. | |
| 2007/0259716 | A1 | 11/2007 | Mattice et al. | |
| 2008/0076505 | A1 | 3/2008 | Nguyen et al. | |
| 2008/0113771 | A1 * | 5/2008 | Baerlocher et al. | 463/25 |
| 2009/0280910 | A1 | 11/2009 | Gagner et al. | |
| 2010/0016075 | A1 | 1/2010 | Thomas | |
| 2010/0120522 | A1 * | 5/2010 | Englman et al. | 463/26 |
| 2010/0210352 | A1 | 8/2010 | Ansari et al. | |
| 2010/0248818 | A1 * | 9/2010 | Aoki et al. | 463/25 |
| 2011/0034239 | A1 * | 2/2011 | Collette et al. | 463/26 |
| 2011/0111840 | A1 | 5/2011 | Gagner et al. | |
| 2012/0075168 | A1 * | 3/2012 | Osterhout et al. | 345/8 |
| 2012/0184351 | A1 * | 7/2012 | Hornik et al. | 463/25 |

(Continued)

FOREIGN PATENT DOCUMENTS

WO WO-2009009224 1/2009

*Primary Examiner* — Michael Cuff
(74) *Attorney, Agent, or Firm* — DeLizio Law, PLLC

(57) ABSTRACT

A system includes a community screen configured to display images of a community event thereon. The system includes a number of wagering game machines coupled to the community screen. The system also includes a number of handheld devices, wherein each handheld device has a respective display and is associated with a respective one of the wagering game machines. The system includes an image module configured, for at least one handheld device of the number of handheld devices, to identify a location on the community screen based on a position of the at least one handheld device and to present an image on the display of the at least one handheld device based on the location.

25 Claims, 21 Drawing Sheets

(56) References Cited

U.S. PATENT DOCUMENTS

2012/0258790 A1* 10/2012 Gomez et al. ..... 463/25
2012/0293548 A1* 11/2012 Perez et al. ..... 345/633
2013/0084948 A1* 4/2013 Watkins et al. ..... 463/23
2013/0127980 A1* 5/2013 Haddick et al. ..... 348/14.08
2014/0274253 A1* 9/2014 Chun ..... 463/11

* cited by examiner

HANDHELD DEVICES FOR COMMUNITY EVENTS OF WAGERING GAMES

RELATED APPLICATIONS

This application claims the priority benefit of U.S. Provisional Application Ser. No. 61/623,917 filed Apr. 13, 2012.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

FIELD

Embodiments of the inventive subject matter relate generally to wagering game systems, and more particularly to wagering game systems including handheld devices for community events of wagering games.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the invention are illustrated in the Figures of the accompanying drawings in which.

DESCRIPTION OF THE EMBODIMENTS

Figure 1:
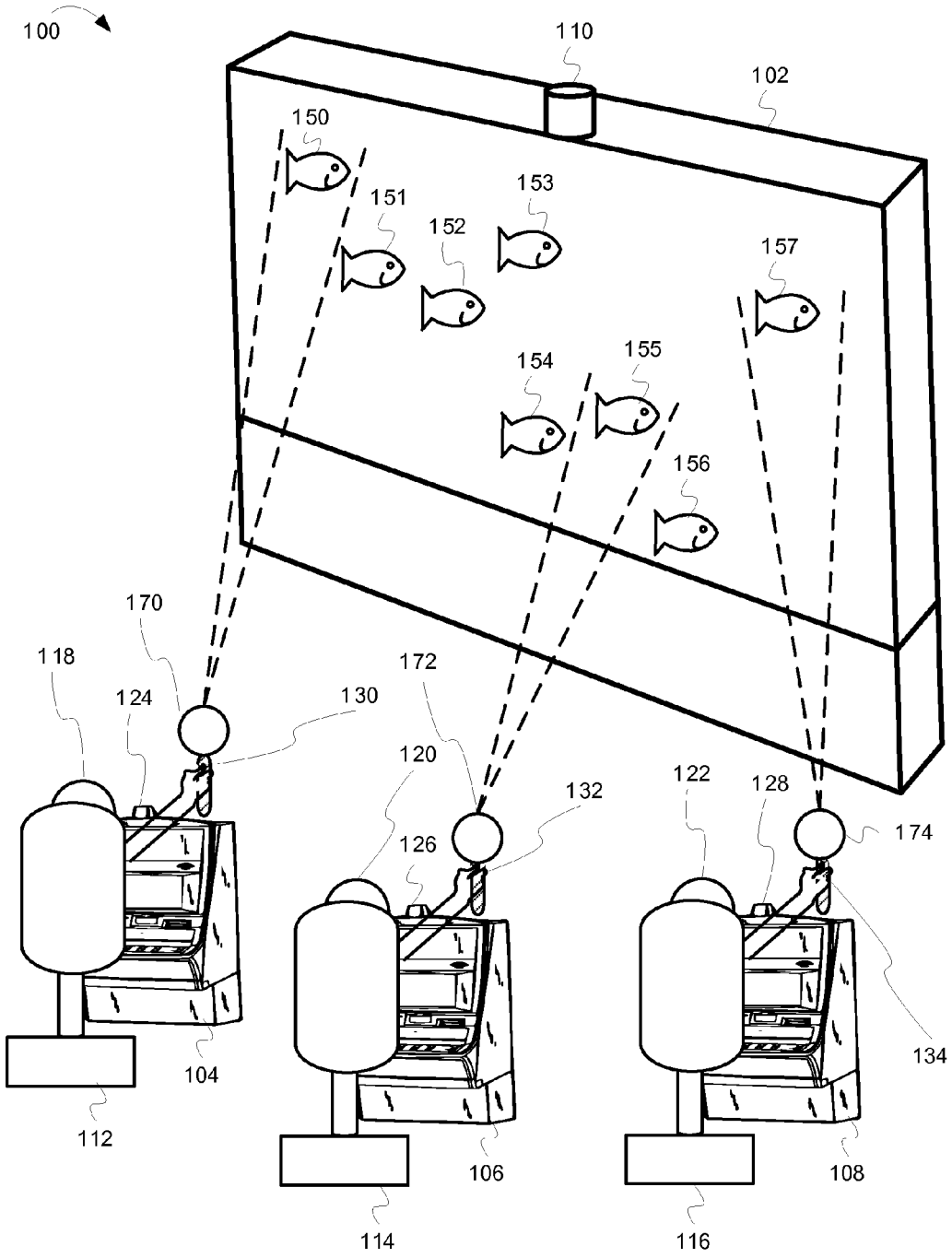
FIG. 1 depicts a wagering game system having handheld devices used in a community event, according to some example embodiments.

This description of the embodiments is divided into seven sections. The first section provides an introduction to some example embodiments, while the second section provides system environments. The third section describes example applications. The fourth section describes example operations performed by some example embodiments. The fifth section describes an example wagering game machine architecture and network environment. The sixth section describes an example wagering game machine and the seventh section presents some general comments.

Introduction

This section provides an introduction to some example embodiments. Some example embodiments are operable in community events in a wagering game environment. In particular, a bank of wagering game machines can share a same community screen (overhead) for community events. These community events are generally triggered at some randomly determined time during base game play at the wagering game machines. Some example embodiments include handheld devices used by the players during the community event to provide a unique experience relative to other wagering game players involved in the community event.

In particular, some example embodiments include handheld devices that are associated with the wagering game machines. Accordingly, each wagering game player playing on a wagering game machine can use (e.g., hold, position, move, etc.) an associated handheld device. The handheld devices can include a display. A player can position the device to view the community screen through the display of the handheld device. For example, the display of the handheld device can be a transmissive Liquid Crystal Display (LCD). In some example embodiments, the handheld devices can include a camera to capture video/images of a part of the community screen that the device is pointing towards. The display of the handheld device can then display the captured video/images. In such a configuration, the displays on the handheld devices can be non-transmissive.

The display on the handheld devices can be used to provide personalized game play in a community environment. In particular, images can be positioned on the displays of the handheld devices. These images can be personalized or specific to the wagering game players. For example, two different wagering game players can see two different images on the displays of the handheld devices even though the handheld devices can be pointing to a same location on the community screen. Accordingly, on the displays of the handheld devices, the wagering game players can view the community screen along with personalized content that is on top of the view of the community event shown through or on the display of the handheld devices.

In some example embodiments, the content of the community screen that is viewed on the display of the handheld device is based on a direction that the wagering game player is facing. In such a configuration, a camera can capture the face of the wagering game player. This capture can be used to determine a direction of the face of the player. The camera can be located on the handheld device, the wagering game machine, the community screen, or any other location that enables the camera to capture the face of the wagering game player. Accordingly, the part of the community screen that is viewed on the display of the handheld device is derived from a line from at least one of the player's head and eyes through the display of the handheld device and to a location on the community screen.

Also, various types of wireless transmissions can be used to capture a location and orientation of the handheld device relative to the community screen to determine what part of the community screen that is to be displayed on the display of the handheld device. Examples of wireless transmissions can include magnetic fields, light, etc. For example, Infra Red (IR) transmissions can be used. The wireless emitters can be in or near the community screen (e.g., bezel) and the wireless receiver can be in the handheld device or vice versa.

Examples of images placed on the displays of the handheld devices can include multipliers when a treasure chest, box, etc. from the community screen is viewed on the display of the handheld device, clues for making determinations (e.g., murderer in a mystery) in the community event, color, etc. In some example embodiments, the objects from the community screen that are viewed on the display of the handheld device are magnified. In some example embodiments, the handheld device includes a selection button to allow the player to denote selection of content on the community screen that is viewed on the display of the handheld device. For example, the player can use the handheld device to view a treasure chest on the display of the handheld device. Upon selection by the player, the images on the display of the handheld device are revealed (e.g., bonus spins, multipliers, etc.).

Accordingly, as described, some example embodiments provide for viewing of content (using a handheld device) that is unique to the wagering game player in a community event of wagering game activity. In addition to randomness, the images that are positioned on the displays of the handheld devices can be based on a number of factors. In some example embodiments, the factors include activities related to the base game play of the associated wagering game machine. For example, images can be associated with awards for the community event. These awards can increase based on the how much the player has wagered during a given period of time (e.g., the last 10 minutes, last hour, etc.), the amount of money deposited in the wagering game machine, etc. In some example embodiments, the factors can be related to loyalty points associated with a player account, how often or how much the player wagers at the wagering game establishment or the particular bank of wagering game machines, etc.

System Environment

FIG. 1 depicts a wagering game system having handheld devices used in a community event, according to some example embodiments. In particular, FIG. 1 depicts a wagering game system 100 that includes a community screen 102, a wagering game machine 104, a wagering game machine 106, and a wagering game machine 108. Each of the wagering game machine 104, the wagering game machine 106, and the wagering game machine 108 can include a wagering game module that is executed to provide communal game play (i.e., a community event) that is playable by wagering game players across the different wagering game machines 104-108. In this example, the community event includes the display of a number of fish that can be selected by the wagering game players for an award (e.g., multiplier, game credits, etc.). The community screen 102 shows fishes 150-157. In some example embodiments, there is an image module within each wagering game machine that receives and processes the wireless transmissions received by the wireless receivers in the wagering game system 100.

Figure 12:
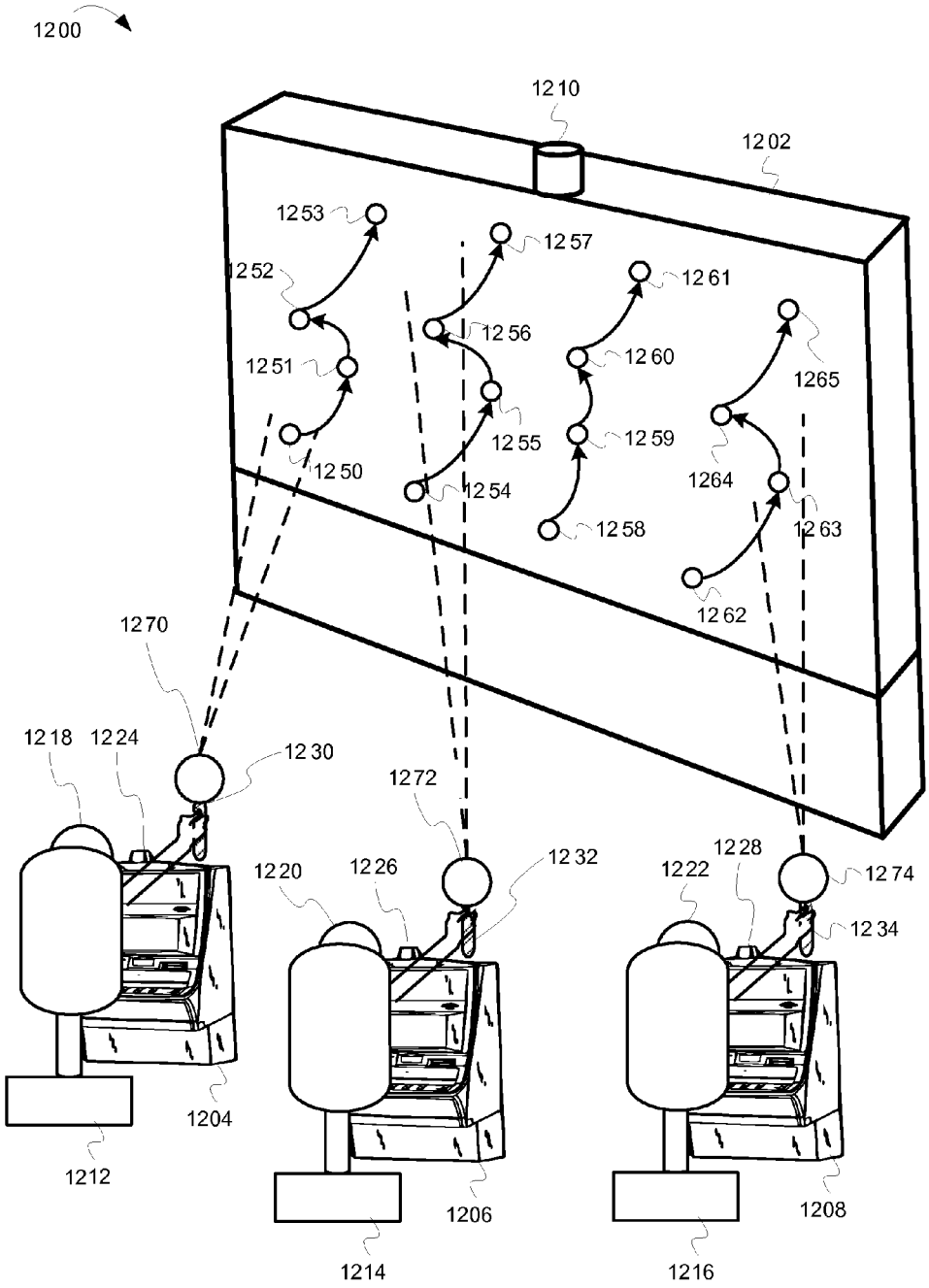
FIG. 12 depicts an example application having multiple paths in the community event that the players can follow using their handheld devices, according to some example embodiments.

Also, the visual output from the communal event is displayed on the community screen 102. Accordingly, the community screen 102, and the wagering game machines 104-108 are communicatively coupled together. An example of a wagering game machine architecture having a wagering game module and an image module is illustrated in FIG. 12, which is described in more detail below. The wagering game system 100 also includes a wireless emitter 110 that is fixedly positioned to the community screen 102. In this example, there is a single wireless emitter fixedly positioned to the community screen 102. In some other example embodiments, the wireless emitter 110 can be positioned at any other location on or near the community screen 102 that can be used to determine movement of the community screen 102 (as further described below). Also in some other example embodiments, there can be multiple wireless emitters fixedly positioned on the community screen 102 (e.g., opposite corners, all four corners, top and bottom, left and right, etc.).

In this example, seats are provided for each of the wagering game machines. A seat 112 is positioned in front of the wagering game machine 104. A seat 114 is positioned in front of the wagering game machine 106. A seat 116 is positioned in front of the wagering game machine 108. A wagering game player 118 is seated in the seat 112 in front of the wagering game machine 104. A wagering game player 120 is seated in the seat 114 in front of the wagering game machine 106. A wagering game player 122 is seated in the seat 116 in front of the wagering game machine 108.

Figure 3:
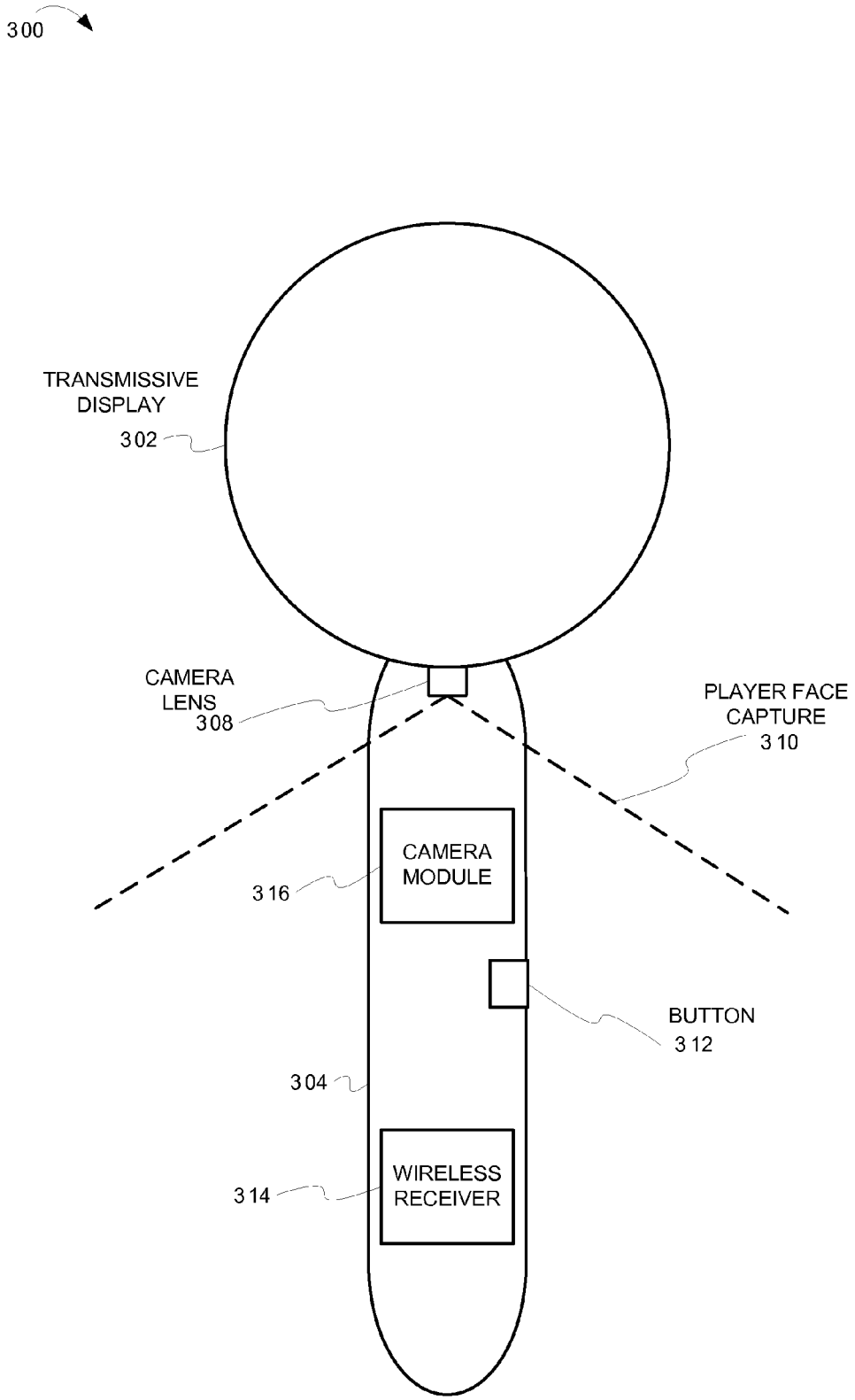
FIG. 3 depicts a handheld device having a camera for capturing an image of the wagering game player's face, according to some example embodiments.
Figure 4:
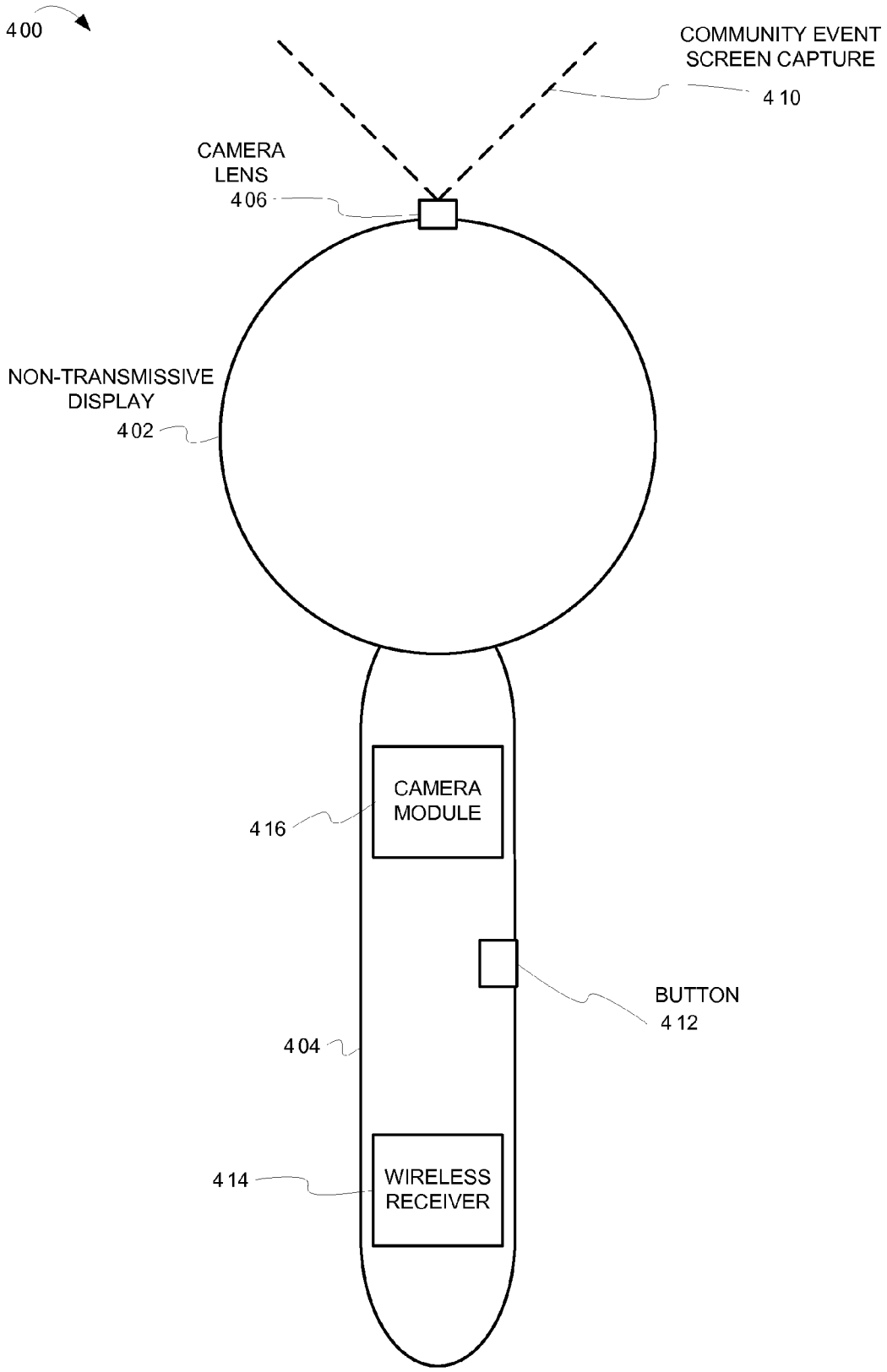
FIG. 4 depicts a handheld device having a camera for capturing an image of what is viewable through the display of the handheld device for presenting a derived image on the display of the handheld device, according to some example embodiments.

Each wagering game machine includes a handheld device. The wagering game machine 104 includes a handheld device 130. The wagering game machine 106 includes a handheld device 132. The wagering game machine 108 includes a handheld device 134. Each of the handheld devices includes a display through which the wagering game player views the community event on the community screen 102. The handheld device 130 includes a display 170. The handheld device 132 includes a display 172. The handheld device 134 includes a display 174. Example embodiments of the handheld devices are shown in FIGS. 3-4, which are described in more detail below. In some example embodiments, the displays of the handheld devices are transmissive displays, wherein the wagering game player can see at least partially through. Such a transmissive display enables different images to be presented thereon (as further described below). In some other example embodiments, the displays of the handheld devices are non-transmissive displays. In such a configuration, a camera can capture what is viewable through the display of the handheld device. These captured images are then displayed on the display of the handheld device. In this example embodiment, different images can be presented on the display of the handheld device. In some example embodiments, the different images presented are derived from the captured images (as further described below). For example, an image can be overlaid onto the captured image to create a derived image. In another example, the captured image can be changed such that new images can be integrated there with. In another example, the captured image may not be a part of the derived image.

Because of these individual handheld devices, wagering game players can have a unique experience during the community event relative to other wagering game players that are viewing the same community screen for the shared community event. In particular, different images that are presented on the display of the handheld device can be unique to the wagering game player that is using the handheld device. For example, two different wagering game players can view a same part of the community event but have different images presented on the displays of their respective handheld devices. The presented images can be prizes won (e.g., multipliers, game credits, etc.), clues for making determinations (e.g., murderer in a mystery) in the community event, colors, etc. In addition to randomness, the presented images can be based on a number of factors. In some example embodiments, the factors include activities related to the base game play of the associated wagering game machine. For example, the presented images can be associated with awards for the community event. These awards can increase based on the how much the player has wagered during a given period of time (e.g., the last 10 minutes, last hour, etc.), the amount of money deposited in the wagering game machine, etc. In some example embodiments, the factors can be related to loyalty points associated with a player account, how often or how much the player wagers at the wagering game establishment or the particular bank of wagering game machines, etc.

The handheld device 130 is communicatively coupled to the image module for the wagering game machine 104. The handheld device 132 is communicatively coupled to the image module for the wagering game machine 106. The handheld device 134 is communicatively coupled to the image module for the wagering game machine 108.

In some example embodiments, each of the handheld devices 130-134 includes a wireless receiver for receiving wireless transmissions from the wireless emitters (e.g., the wireless emitter 110). Examples of wireless transmissions can include magnetic fields, light, etc. For example, Infra Red (IR) transmissions can be used. The wireless emitters can be in or near the community screen (e.g., bezel) and the wireless receiver can be in the handheld device or vice versa. In some example embodiments, the emitters are three-axis electromagnetic sources that include three orthogonal antennas that output magnetic fields. In some example embodiments, the receivers are three-axis electromagnetic sensors that include three orthogonal antennas that receive the magnetic fields output from the emitters.

In FIG. 1, the wagering game player 118, the wagering game player 120, and the wagering game player 122 are using their handheld devices—the handheld device 130, the handheld device 132, and the handheld device 134, respectively—to provide input into the communal event that is being displayed on the community screen 102.

In particular while holding the handheld devices, the wagering game players can view different parts of the community screen 102 through the display of the handheld device. In this example, the wagering game player 118 is viewing the fish 150 through the display 170 of the handheld device 130. The wagering game player 120 is viewing the fish 155 through the display 172 of the handheld device 132. The wagering game player 122 is viewing the fish 157 through the display 174 of the handheld device 134. In some example embodiments, the images on the displays of the handheld devices are magnified. In some example embodiments, the images presented on the displays of the handheld devices do not change if the handheld devices are rotated. In some example embodiments, the images presented do not change (to a first order approximation) if the handheld devices are twisted horizontally or vertically. In particular, the image module accounts for these rotations and twisting such that the image remains essentially constant even when the handheld devices are rotated or twisted. For example, the image module counter-rotates the image relative to the rotation of the handheld device so that the image is not rotated even while the handheld device is rotated. Additionally, different images can be presented. Also as further described below, the handheld device can include a button to allow the wagering game player to confirm a selection of what is being viewed on the displays of the handheld devices. Such input can trigger the presenting of an image on the display of the handheld device. For example, after the wagering game player 118 positions the handheld device 130 such that the fish 150 is viewable on the display 170, the wagering game player 118 can select a button. In response, an image is overlaid over the fish 150 on the display 170 of the handheld device to indicate a prize that is won (e.g., multiplier, game credits, etc.).

The wireless transmissions can be captured and processed to determine what is being viewed through the displays of the handheld devices. Based on what is being viewed, the identification of the wagering game player, etc., the image to be presented on the displays of the handheld devices can be determined. In particular, the wireless transmissions from the wireless emitters and received by a wireless receiver in the handheld device can be provided to the image module to determine a position and angle of the handheld device. Both the position and angle of the handheld device provides an accurate determination of what the wagering game player is viewing through the displays of the handheld devices.

In some example embodiments, after capturing these wireless transmissions, the receivers forward this data to the image module for further processing. In some example embodiments, there is an image module within each wagering game machine.

In some example embodiments, the image module processes the wireless transmissions (the analog signal) to produce six different data values that represent the position and angle of each of the wireless emitters to the wireless receiver: three linear measurements (X component, Y component, and Z component) and three angular measurements (X component, Y component, and Z component). Table 1 below is an example (for the receiver in the handheld device) of the six values for the position and orientation for the wireless transmissions:

TABLE 1

| Gameplay Wireless Transmission | X Comp. Linear Measure | Y Comp. Linear Measure | Z Comp. Linear Measure | X Comp. Angular Measure | Y Comp. Angular Measure | Z Comp. Angular Measure |
|---|---|---|---|---|---|---|
| Transmission | 70 | 40 | 15 | 65° | 50° | 25° |

The position module can use these values from the wireless transmissions to determine a position and angle for the handheld device.

Figure 2:
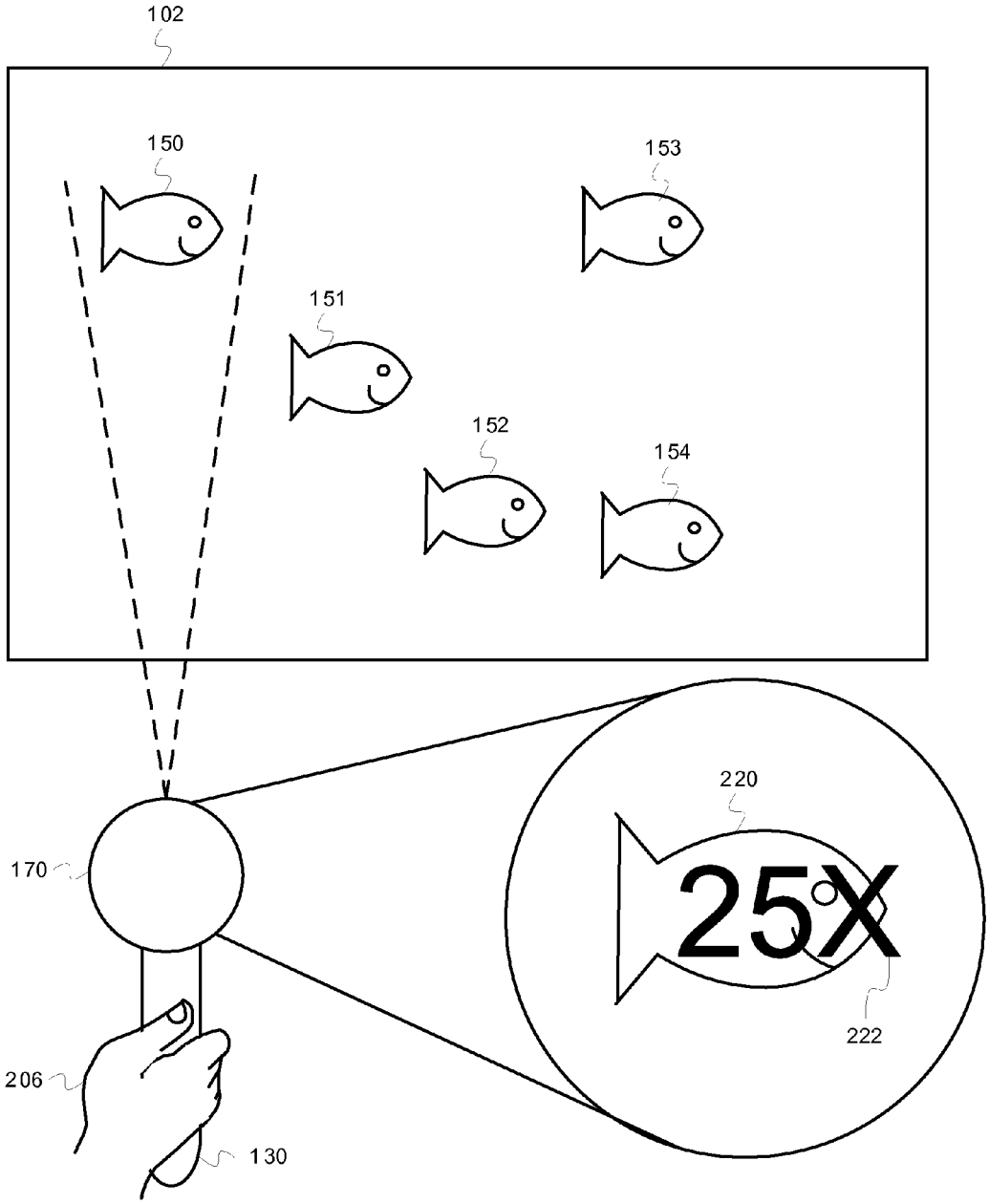
FIG. 2 depicts an example image that is presented on a display of a handheld device, according to some example embodiments.

FIG. 2 depicts an example image that is presented on a display of a handheld device, according to some example embodiments. In particular, FIG. 2 depicts a portion of the wagering game system 100 of FIG. 1 that includes an example image that is presented on the display 170 of the handheld device 130.

FIG. 2 depicts the community screen 102 that shows the fishes 150-154. A hand 206 of the wagering game player 118 is holding the handheld device 130 such that the wagering game player 118 is viewing the fish 150. The image of the fish 150 on the display 170 is shown as a fish 220. In this example, the fish 220 has been magnified. Alternatively, the fish on the display 170 is not magnified. In this example, an image 222 is presented over the image of the fish 220. The image 222 indicates that the player won a 25× multiplier for use in the base game on the wagering game machine after the community event is complete. The image 222 can be revealed after the wagering game player 118 puts the fish 150 into view on the display 170 and provides some input (e.g., button selection) to confirm selection of the fish 150.

Based on the wireless transmissions, the display module can determine a position and angle of the handheld device 130. Based on the position and angle, the image module can determine what is being viewed on the display 170 (as described above). The image module can then determine the image based on different criteria (e.g., random number generation, the identification of the wagering game player, etc.). As further described below in some example embodiments, a camera can capture the face of the wagering game player to help determine what is being viewed on the display 170. The image module determines a direction that the head of the player based on any of a number of facial recognition algorithms (e.g., three dimensional recognition, skin texture analysis, etc.). A camera or cameras can be on at any location to capture an image of the wagering game player (e.g., the handheld device, the wagering game machine, the display, or any combination thereof).

Two different example embodiments of a more detailed block diagram of a handheld device are now described in reference to FIGS. 3-4.

FIG. 3 depicts a handheld device having a camera for capturing an image of the wagering game player's face, according to some example embodiments. A handheld device 300 includes a transmissive display 302 positioned on top of a handle 304. The handheld device 300 also includes a camera lens 308. In this example, the handle 304 is configured to store a wireless receiver 314 and a camera module 316. In some example embodiments, the image module can be within the handle 304 (instead of executing within the associated wagering game machine). Although not shown, the handle 304 can include a machine-readable media for storage of the images captured by the camera lens 308, wireless transmissions captured by the wireless receiver 314, etc. Additionally, although not shown in some example embodiments, the handle 304 includes a processor for execution of the camera module 316 and the image module. In this example, the handheld device 300 includes a button 312 to allow the player to denote selection of content on the community screen that is viewed on the display of the handheld device.

The wireless receiver 314 is configured to capture the wireless transmissions from the wireless emitters (e.g., emitters within the community screen 102 that is displaying the community event). The camera module 316 can be software, hardware, firmware or a combination thereof. The camera module 316 is communicatively coupled to the camera lens 308. The camera module 316 is configured to control the camera lens 308 and to receive the images captured by the camera lens 308 for storage either in a local or remote machine-readable media. The camera lens 308 is positioned towards the face of the wagering game player to capture images of the face. The camera lens can capture these images during times when what is being viewed on the transmissive display 302 is to be determined.

During operation, the camera module 316 receives an instruction from the image module that the player has selected an image or object on the community screen 102 that is being viewed on the transmissive display 302. For example, after positioning an image from the community event on the transmissive display 302, the player can select the button 312. In response, the camera module 316 causes the camera lens 308 to capture an image of the player's face (player face capture 310). This image can then be transmitted to the image module. The image module can then determine a direction that the player is looking (e.g., up, down, left, right) relative to the transmissive display 302. In some example embodiments, the direction is based on the position of the transmissive display 302 and the head of the player. In particular, the position of the transmissive display 302 and the head of the player force a gaze direction to enable the player to see the image through the transmissive display 302. The image module can then use this direction to more accurately determine what the player is actually viewing and selecting among the different graphic elements of the community event. A further description of using the gaze direction in some example embodiments is set forth below. Knowing this image then enables the image module to derive an image there from for presenting on the transmissive display 302 (as described above).

FIG. 4 depicts a handheld device having a camera for capturing an image of what is viewable through the display of the handheld device for presenting a derived image on the display of the handheld device, according to some example embodiments. A handheld device 400 includes a non-transmissive display 402 positioned on top of a handle 404. The handheld device 400 also includes a camera lens 406. In this example, the handle 404 is configured to store a wireless receiver 414 and a camera module 416. In some example embodiments, the image module can be within the handle 404 (instead of executing within the associated wagering game machine). Although not shown, the handle 404 can include a machine-readable media for storage of the images captured by the camera lens 406, wireless transmissions captured by the wireless receiver 414, etc. Additionally, although not shown in some example embodiments, the handle 404 includes a processor for execution of the camera module 416 and the image module. In this example, the handheld device 400 includes a button 412 to allow the player to denote selection of content on the community screen that is viewed on the display of the handheld device.

The wireless receiver 414 is configured to capture the wireless transmissions from the wireless emitters (e.g., emitters within the community screen 102 that is displaying the community event). The camera module 416 can be software, hardware, firmware or a combination thereof. The camera module 416 is communicatively coupled to the camera lens 406. The camera module 416 is configured to control the camera lens 408 and to receive the images captured by the camera lens 408 for storage either in a local or remote machine-readable media. The camera lens 408 is positioned towards the community screen 102 that is displaying the community event. The camera lens 408 captures images that would be viewable through the non-transmissive display 402 by the player. The camera module 416 than displays these images on the non-transmissive display 402. In some example embodiments, an image can be derived from these captured images. These derived images can be overlaid onto the captured images. Alternatively or in addition, the captured images are not included or changed for display on the non-transmissive display 401

During operation, the camera module 416 receives an instruction from the image module that the handheld device 400 is operational. In response, the camera module 416 begins capturing images through the camera lens 406 for display on the non-transmissive display 402. The image module can present derived images (that may or may not be included the captured images) on the non-transmissive display 402 (as described above).

While described separately, components of these two examples can be combined in FIGS. 3 and 4 can be combined into a same handheld device. Accordingly, the handheld device would include two different cameras whose lens are facing essentially in opposite directions—1) for capturing images of the player's face (see FIG. 3), and 2) for capturing images of the community event.

Figure 5:
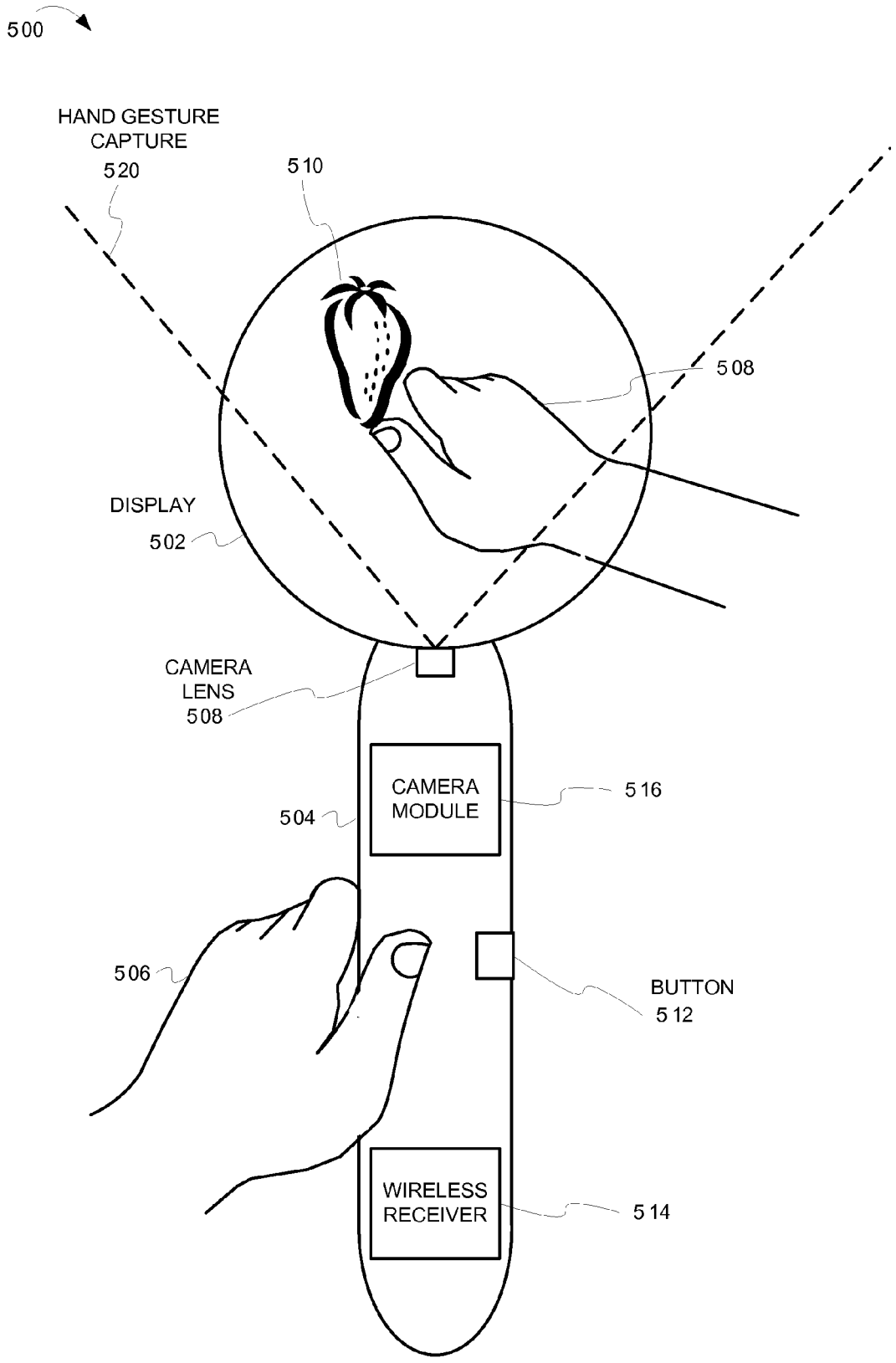
FIG. 5 depicts an example application where the player's hand gesture in front of the display of handheld device is used as player input into the community event, according to some example embodiments.

FIG. 5 depicts an example application where the player's hand gesture in front of the display of handheld device is used as player input into the community event, according to some example embodiments. In particular in this example, the player can move their hand in front of the handheld device 500. The player can make different hand gestures using the hand to provide for different player input. The handheld device 500 includes a display 502 that is positioned on top of a handle 504. In this example, the handheld device 500 includes a button 512 to allow the player to denote selection of content on the community screen that is viewed on the display of the handheld device. The handheld device 500 also includes a camera lens 508.

In this example, the handle 504 is configured to store a wireless receiver 514 and a camera module 516. In some example embodiments, the image module can be within the handle 504 (instead of executing within the associated wagering game machine). Although not shown, the handle 504 can include a machine-readable media for storage of the images captured by the camera lens 508, wireless transmissions captured by the wireless receiver 514, etc. Additionally, although not shown in some example embodiments, the handle 504 includes a processor for execution of the camera module 516 and the image module.

The two hands of a wagering game player are also shown. A hand 506 is holding the handle 504 for controlling what is being viewed on or through the display 502. A hand 508 is making a hand gesture in front of the display 502 such that the hand 508 is viewable on or through the display 502. In this example, the hand gesture is a picking or grabbing of a graphic element 510 (a strawberry) that is part of the community event. This hand gesture can represent player input for selection of the graphic element 510. In such an example, the player is not required to select the button 512 to indicate selection.

In some example embodiments, the hand 508 can be graphically changed. For example, the hand 508 can be graphically changed to match a theme for the community event, the theme for the associated wagering game machine, etc. Examples include a monster hand for a monster-based theme, a hand with chain-mail armor for a medieval-based them, etc.

During operation, the camera module 516 receives an instruction from the image module that the handheld device 500 is operational. In response, the camera module 516 begins capturing images through the camera lens 508 for display on the display 502 (shown as hand gesture capture 520). The image module can then process these images for tracking the hand 508. Based on this tracking, the image module can determine different hand gestures that represent different user input. For example, the image module can determine whether the hand 508 is grabbing, pointing, etc. at a location that is a graphic element being viewed through or on the display 502. The image module can use image processing for these different images to make this determination (e.g., 3D modeling-based algorithms, skeletal-based algorithms, etc). Once determined, the image module can provide this input to the wagering game module, provide a result of the community event, etc. For example, based on this input, the image module can present an image on the display 502 that represents an award for the community event (e.g., multipliers, game credits, etc.).

As described above, the image module can determine the direction that the player is looking relative to the display of the handheld device based on the position of the display of the handheld device and the head of the player. In some example embodiments, the gaze of the player looking at the community screen through the display of the handheld device can also be assisted. FIGS. 6-10 help illustrate the various configurations for assisting the player for gazing in the correct direction of the community screen relative to the display of the handheld device, according to some example embodiments.

Figure 6:
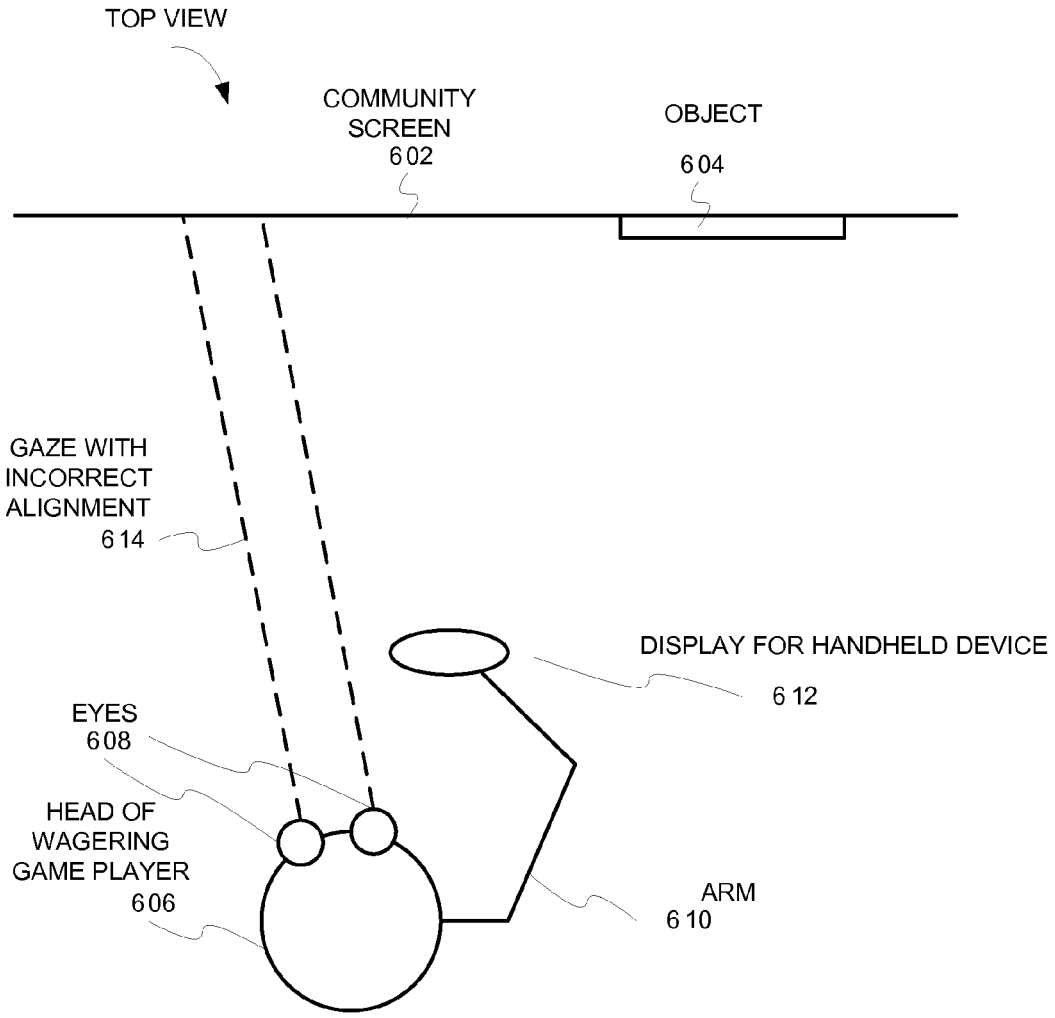
FIG. 6 depicts an incorrect gaze of a player at the community screen relative to the display of the handheld device, according to some example embodiments.

FIG. 6 depicts an incorrect gaze of a player at the community screen relative to the display of the handheld device, according to some example embodiments. In particular, FIG. 6 depicts a top view of a community screen 602, a display 612 of a handheld device, and a wagering game player (including a head 606, eyes 608, and an arm 610). The arm 610 of the player is holding the handheld device. Also, an object 604 is on the community screen 602. As shown, the eyes 608 of the player are gazing in the wrong direction—gaze with incorrect alignment 614. In particular, the eyes 608 of the player are not gazing through the display 612 of the handheld device.

Figure 7:
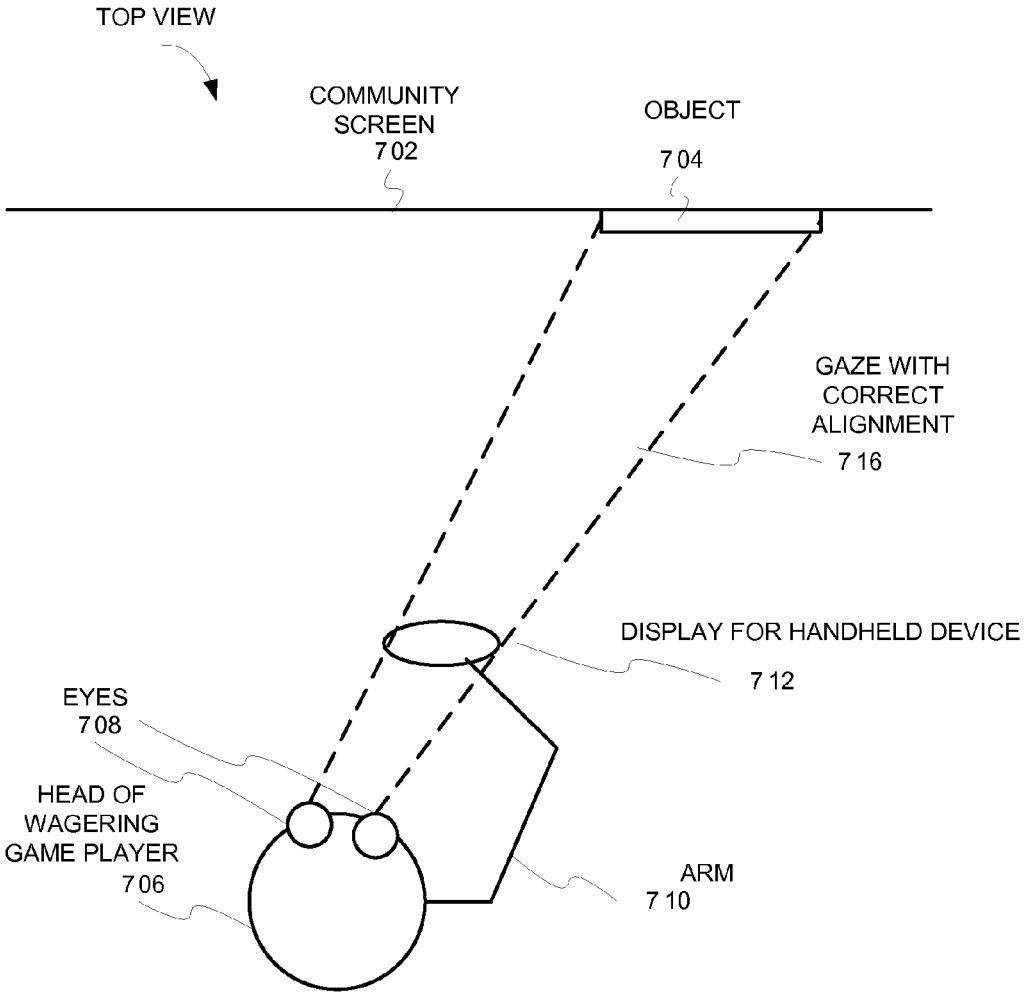
FIG. 7 depicts a correct gaze of a player at the community screen relative to the display of the handheld device, according to some example embodiments.

FIG. 7 depicts a correct gaze of a player at the community screen relative to the display of the handheld device, according to some example embodiments. In particular, FIG. 7 depicts a top view of a community screen 702, a display 712 of a handheld device, and a wagering game player (including a head 706, eyes 708, and an arm 710). The arm 710 of the player is holding the handheld device. Also, an object 704 is on the community screen 702. As shown, the eyes 708 of the player are gazing in the correct direction—gaze with correct alignment 716. In particular, the eyes 708 of the player are gazing through the display 712 of the handheld device to view the object 704 on the community screen 702.

Figure 8:
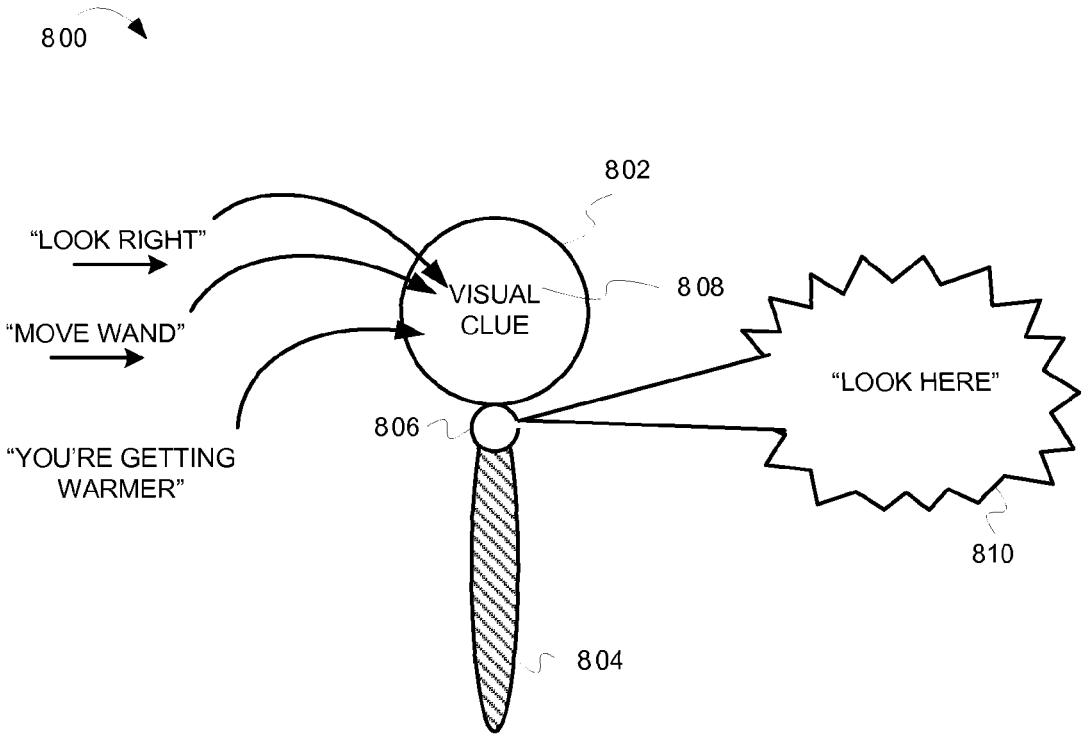
FIG. 8 depicts a handheld device that assists the player in gazing in the correct direction, according to some example embodiments.

FIG. 8 depicts a handheld device that assists the player in gazing in the correct direction, according to some example embodiments. In particular, FIG. 8 depicts a handheld device 800 that includes both visual and audible clues for assisting the player in gazing in the correct direction. The handheld device 800 includes a display 802 attached to a handle 804. The display 802 of the handheld device 800 includes a visual clue 808. In particular, different types of visual clues can be displayed to the player to assist the player in gazing in the right direction, adjusting the handheld device, etc. Examples include a clue to "look right"—a clue to adjust the player's gaze to the right; "move wand"—a clue to adjust the handheld device to the right; and "you're getting warmer"—a clue that the player is adjusting (e.g., their gaze) in the right direction. The handheld device 800 also includes a speaker 806 that provides audible clues. In this example, an audible clue 810 attempts to have the player gaze in the direction of the display 802 of the handheld device 800. With reference to FIGS. 6-7 described above, these different clues can cause the player to adjust their gaze to look in the correct direction (gaze with correct alignment 716) from an incorrect direction (gaze with incorrect alignment 614).

Figure 9:
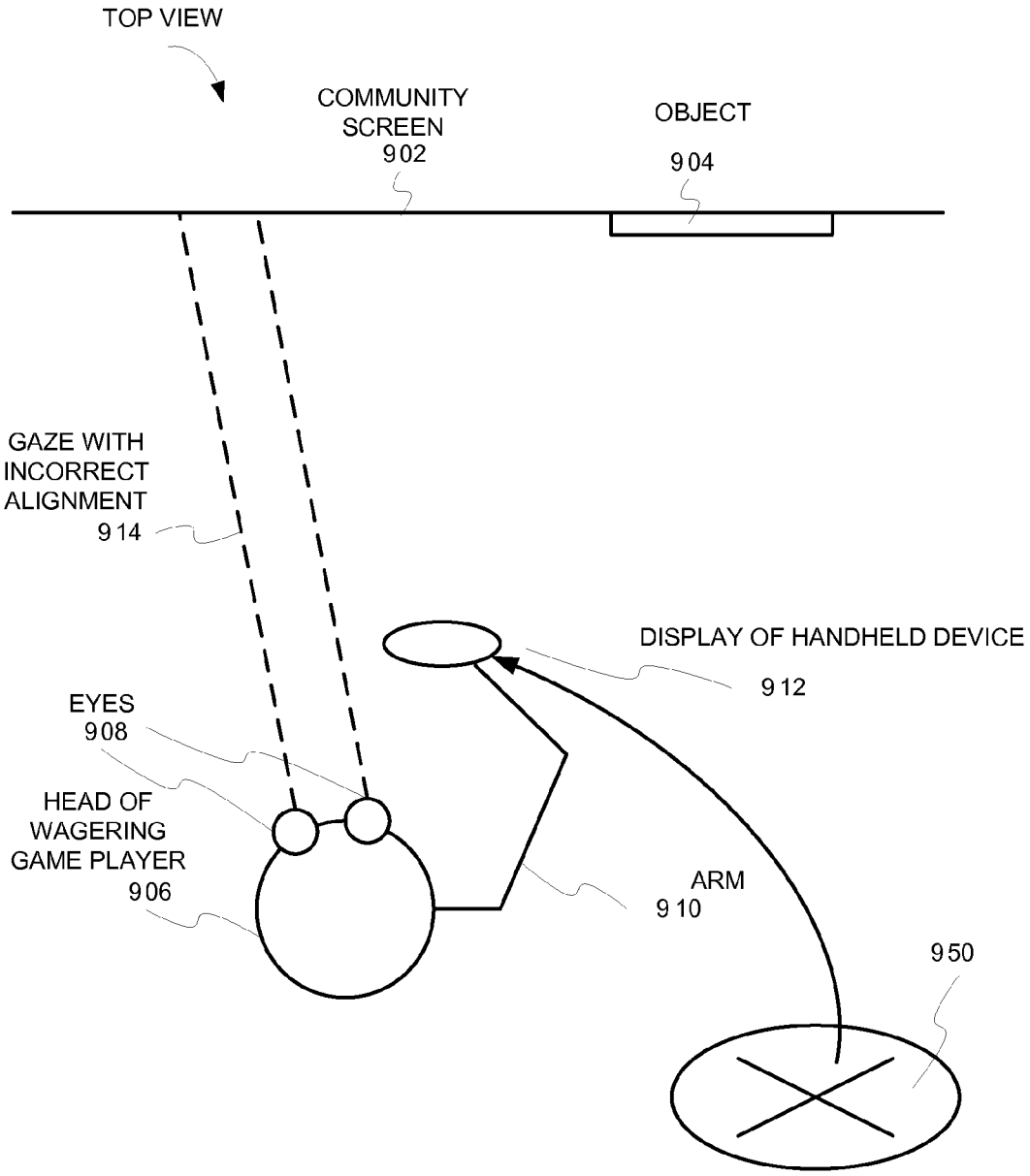
FIG. 9 depicts a clue provided in response to an incorrect gaze of a player at the community screen relative to the display of the handheld device, according to some example embodiments.

FIG. 9 depicts a clue provided in response to an incorrect gaze of a player at the community screen relative to the display of the handheld device, according to some example embodiments. In particular, FIG. 9 depicts a top view of a community screen 902, a display 912 of a handheld device, and a wagering game player (including a head 906, eyes 908, and an arm 910). The arm 910 of the player is holding the handheld device. Also, an object 904 is on the community screen 902. As shown, the eyes 908 of the player are gazing in the wrong direction—gaze with incorrect alignment 914. In particular, the eyes 908 of the player are not gazing through the display 912 of the handheld device toward the object 904 on the community screen 902. In response, a visual clue 950 (a giant X) is displayed on the display 912 of the handheld device. This visual clue 950 can be removed after the player is gazing in the right direction.

Figure 10:
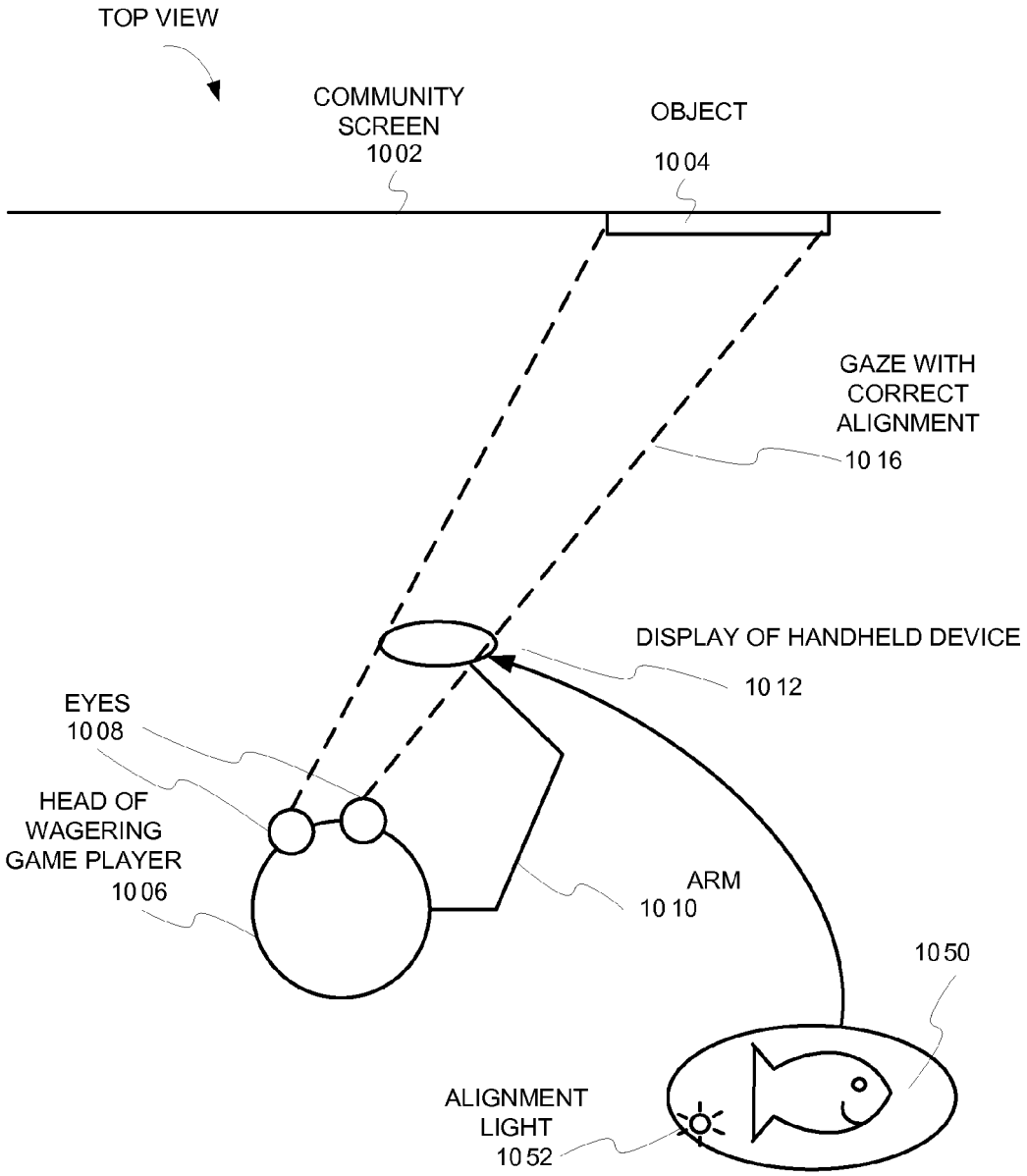
FIG. 10 depicts a clue provided in response to a correct gaze of a player at the community screen relative to the display of the handheld device, according to some example embodiments.

FIG. 10 depicts a clue provided in response to a correct gaze of a player at the community screen relative to the display of the handheld device, according to some example embodiments. In particular, FIG. 10 depicts a top view of a community screen 1002, a display 1012 of a handheld device, and a wagering game player (including a head 1006, eyes 1008, and an arm 1010). The arm 1010 of the player is holding the handheld device. Also, an object 1004 is on the community screen 1002. As shown, the eyes 1008 of the player are gazing in the right direction—gaze with correct alignment 1016. In particular, the eyes 1008 of the player are gazing through the display 1012 of the handheld device toward the object 1004 on the community screen 1002. In response, an alignment light 1052 on the display 1012 is lit to indicate proper alignment.

Example Applications

Figure 11:
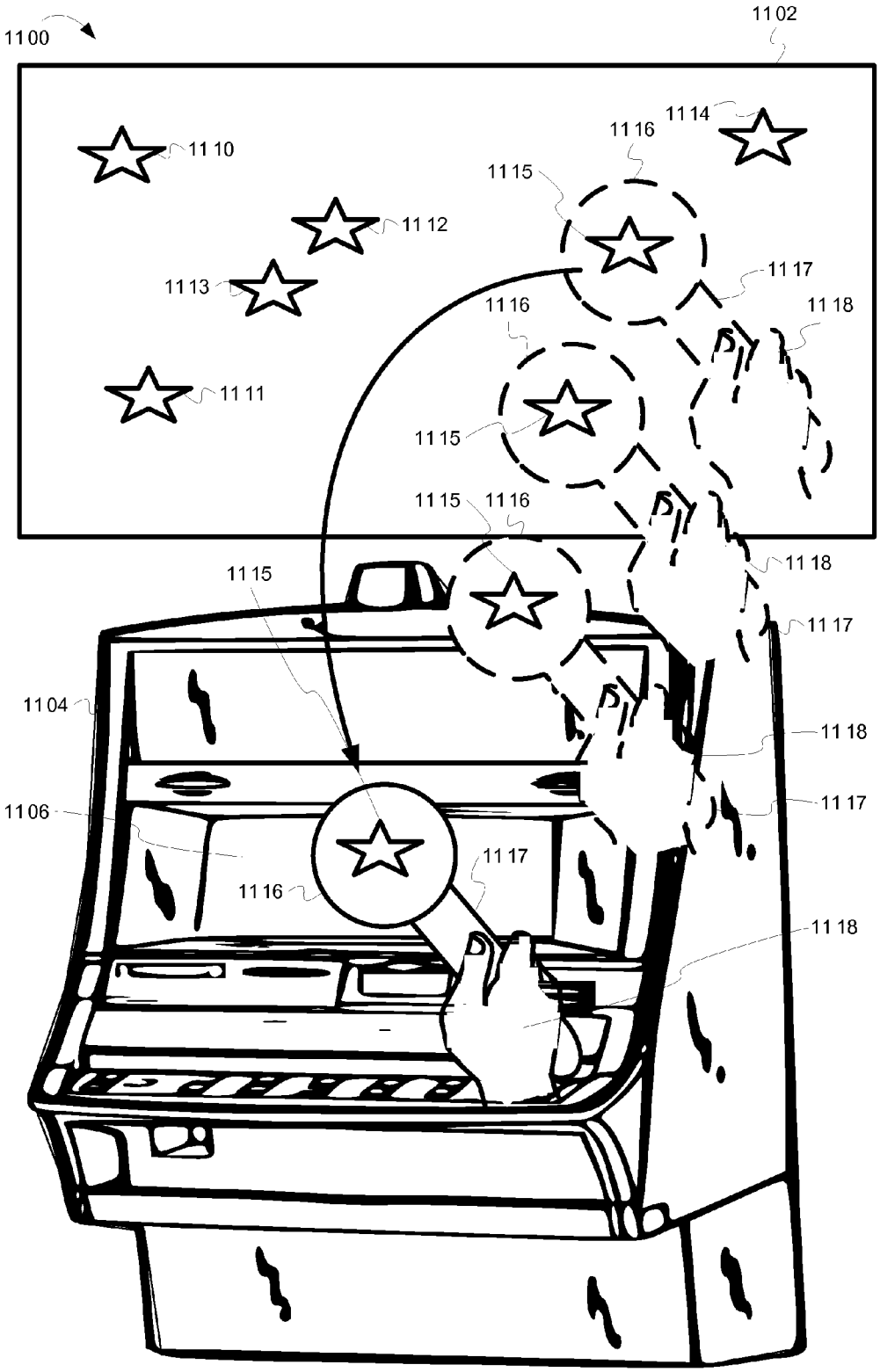
FIG. 11 depicts an example application where a player uses their handheld device to drag-and-drop a graphic element from the community screen to a display of their wagering game machine, according to some example embodiments.

FIG. 11 depicts an example application where a player uses their handheld device to drag-and-drop a graphic element from the community screen to a display of their wagering game machine, according to some example embodiments. For example, a graphic element can represent an award that will affect game play at the wagering game machine after the graphic element is dragged from the community screen of the community event to a display on the wagering game machine.

A system 1100 includes a community screen 1102 for displaying a community event and a wagering game machine 1104. The community screen 1102 is displaying a number of stars as part of a community event—stars 1110-1115. The wagering game machine 1104 includes a main display 1106. For example, the main display 1106 can include spinning reels as part of slot machine play.

In this example, a hand 1117 of a wagering game player is moving the star 1115 (that has been selected) from the community screen 1102 to the main display 1106 of the wagering game machine 1104 using a handheld device 1117 having a display 1116. Similar to the community screen 102 of FIG. 1 (described above), the wagering game machine 1104 includes a number of wireless emitters that communicate with the wireless receiver in the handheld device 1117. For example, the bezel surrounding the main display 1106 of the wagering game machine 1104 can include a number of wireless emitters at different locations (e.g., opposite corners, all four corners, top and bottom, left and right, etc.). Other wireless emitters can be positioned on the top, sides and bottom of the wagering game machine 1104. Similar to the system 100 of FIG. 1 described above, the wireless receiver and the wireless emitters can be switched. The handheld device 1117 can then be tracked using the combination of wireless emitters in the community screen 1102 and the wireless emitters in the wagering game machine 1104. In some example embodiments, the wagering game player can select a button (on the handheld device 1117) to release the star 1115 onto the main display 1106 of the wagering game machine 1104. In response, an award that affects the base game play in the wagering game machine 1104 can be revealed (e.g., game credits, multipliers, etc.). In some example embodiments, the award can be revealed to the wagering game player through the display 1116 of the handheld device 1117 and/or the main display 1106 of the wagering game machine 1104.

In some example embodiments, the handheld device 1117 includes a camera for capturing the community event for display on the display 1116 (similar to the handheld device 400 of FIG. 4). In some example embodiments, the handheld device 1117 includes a camera for capturing the player's face for assistance in tracking what is being viewed on the display 1117 (similar to the handheld device 300 of FIG. 3).

FIG. 12 depicts an example application having multiple paths in the community event that the players can follow using their handheld devices, according to some example embodiments. In this example application, the community event includes four different paths that the wagering game player can select. The wagering game player traverses the selected path and stopping at different points to reveal an award. The wagering game players can each select their own path. Also, the awards at the different points are only revealed on the display of the handheld device. Accordingly, only the wagering game player that is traversing the path can know the awards for that path. In some example embodiments, a player can switch to a different path based on the reaction of a different player that is traversing this different path. For example, if the different player is expressing excitement regarding the reveal of the awards along the different path, a player might switch to the different path (at an equivalent point along the different path).

FIG. 12 depicts a wagering game system 1200 that includes a community screen 1202, a wagering game machine 1204, a wagering game machine 1206, and a wagering game machine 1208. Each of the wagering game machine 1204, the wagering game machine 1206, and the wagering game machine 1208 can include a wagering game module that is executed to provide communal game play (i.e., a community event) that is playable by wagering game players across the different wagering game machines 1204-1208. In this example, the community event includes the display of four different paths with different reveal points. The reveal points reveal if the player won an award at this point in the path (e.g., multiplier, game credits, etc.). The community screen 1202 shows a first path that includes reveal points 1250-1253, a second path that includes reveal points 1254-1257, a third path that includes reveal points 1258-1261, and a fourth path that includes reveal points 1262-1265. In some example embodiments, there is an image module within each wagering game machine that receives and processes the wireless transmissions received by the wireless receivers in the wagering game system 1200.

Figure 17:
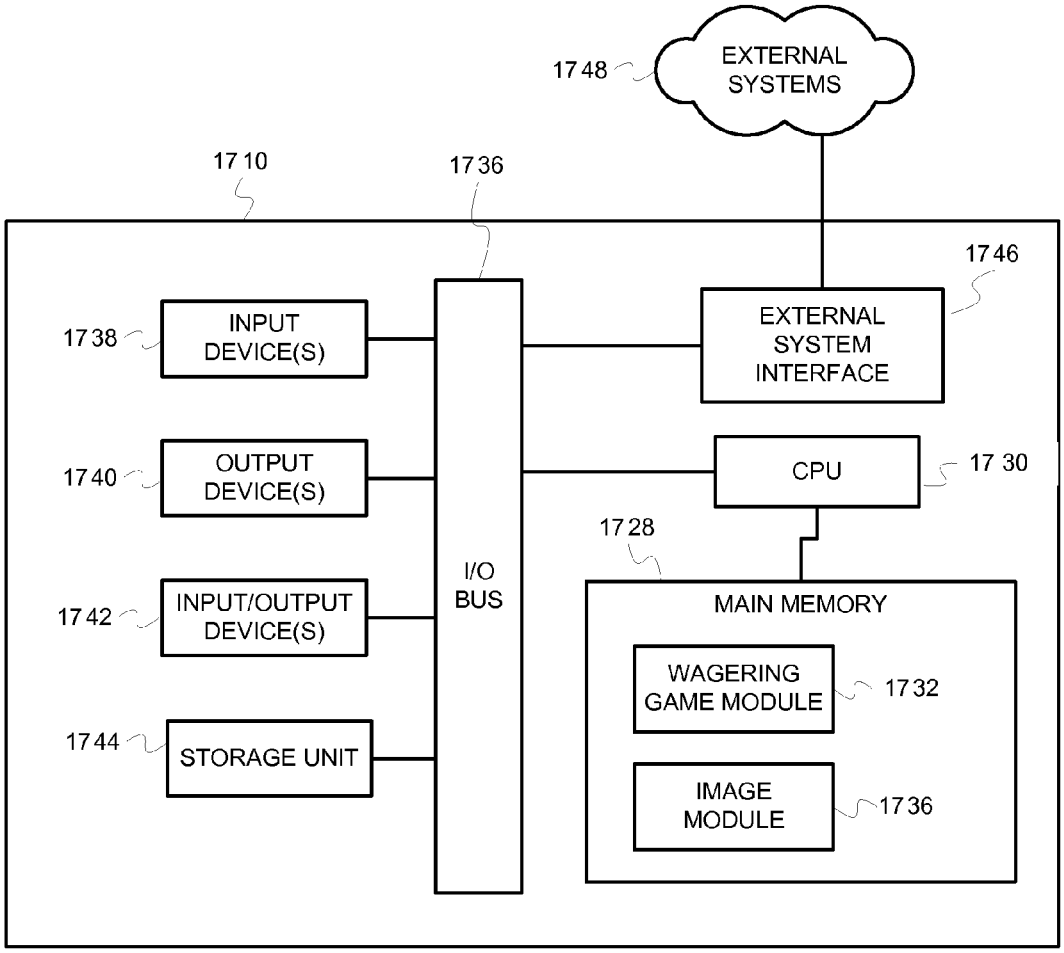
FIG. 17 is a block diagram illustrating a wagering game machine architecture, according to some example embodiments.

Also, the visual output from the communal event is displayed on the community screen 1202. Accordingly, the community screen 1202 and the wagering game machines 1204-1208 are communicatively coupled together. An example of a wagering game machine architecture having a wagering game module and an image module is illustrated in FIG. 17, which is described in more detail below. The wagering game system 1200 also includes a wireless emitter 1210 that is fixedly positioned to the community screen 1202. In this example, there is a single wireless emitter fixedly positioned to the community screen 1202. In some other example embodiments, the wireless emitter 1210 can be positioned at any other location on or near the community screen 1202 that can be used to determine movement of the handheld devices. Also in some other example embodiments, there can be multiple wireless emitters fixedly positioned on the community screen 1202 (e.g., opposite corners, all four corners, top and bottom, left and right, etc.).

In this example, seats are provided for each of the wagering game machines. A seat 1212 is positioned in front of the wagering game machine 1204. A seat 1214 is positioned in front of the wagering game machine 1206. A seat 1216 is positioned in front of the wagering game machine 1208. A wagering game player 1218 is seated in the seat 1212 in front of the wagering game machine 1204. A wagering game player 1220 is seated in the seat 1214 in front of the wagering game machine 1206. A wagering game player 1222 is seated in the seat 1216 in front of the wagering game machine 1208.

Each wagering game machine includes a handheld device. The wagering game machine 1204 includes a handheld device 1230. The wagering game machine 1206 includes a handheld device 1232. The wagering game machine 1208 includes a handheld device 1234. Each of the handheld devices includes a display through which the wagering game player can view the community event on the community screen 1202. The handheld device 1230 includes a display 1270. The handheld device 1232 includes a display 1272. The handheld device 1234 includes a display 1274.

Because of these individual handheld devices, wagering game players can have a unique experience during the community event relative to other wagering game players that are viewing the same community screen for the shared community event. In particular, different images that are presented on the displays of the handheld devices can be unique to the wagering game player that is using the handheld device. For example, two different wagering game players can view a same part of the community event but have different images presented on the displays of their handheld devices. The presented images can be prizes won (e.g., multipliers, game credits, etc.), clues for making determinations (e.g., murderer in a mystery) in the community event, colors, etc. In addition to randomness, the presented images can be based on a number of factors. In some example embodiments, the factors include activities related to the base game play of the associated wagering game machine. For example, images can be associated with awards for the community event. These awards can increase based on the how much the player has wagered during a given period of time (e.g., the last 10 minutes, last hour, etc.), the amount of money deposited in the wagering game machine, etc. In some example embodiments, the factors can be related to loyalty points associated with a player account, how often or how much the player wagers at the wagering game establishment or the particular bank of wagering game machines, etc.

The handheld device 1230 is communicatively coupled to the image module for the wagering game machine 1204. The handheld device 1232 is communicatively coupled to the image module for the wagering game machine 1206. The handheld device 1234 is communicatively coupled to the image module for the wagering game machine 1208. In some example embodiments, each of the handheld devices 1230-1234 includes a wireless receiver for receiving wireless transmissions from the wireless emitters (e.g., the wireless emitter 1210). In FIG. 12, the wagering game player 1218, the wagering game player 1220, and the wagering game player 1222 are using their handheld devices—the handheld device 1230, the handheld device 1232, and the handheld device 1234, respectively—to provide input into the communal event that is being displayed on the community screen 1202.

In particular while holding the handheld devices, the wagering game players can view different parts of the community screen 1202 through the display of the handheld device. In this example, the wagering game player 1218 is viewing the reveal point 1250 along the first path through the display 1270 of the handheld device 1230. The wagering game player 1220 is viewing the reveal point 1256 along the second path through the display 1272 of the handheld device 1232. The wagering game player 1222 is viewing the reveal point 1263 along the fourth path through the display 1274 of the handheld device 1234.

In some example embodiments, the images on the displays of the handheld devices are magnified. Also as further described below, the handheld device can include a button to allow the wagering game player to confirm a selection of what is being viewed on the displays of their handheld devices. Such input can trigger the presenting of an image on the display of the handheld device. For example, after the wagering game player 1218 positions the handheld device 1230 such that the reveal 1250 is viewable on the display 1270, the wagering game player 1218 can select a button. In response, an image is overlaid over the reveal point 1250 on the display 1270 to indicate a prize that is won (e.g., multiplier, game credits, etc.). The wireless transmissions can be captured and processed to determine what is being viewed through the displays of the handheld devices. Based on what is being viewed, the identification of the wagering game player, etc., the image to be presented on the display of the handheld device can be determined (as described above).

In this example application, players can switch paths during the community event. For example, assume that the wagering game player 1220 is celebrating based on reveals along the second path and the wagering game player 1218 is not winning any awards at the reveal points along the first path. The wagering game player 1218 can move to the second path at the reveal point 1255. As noted above, the awards for different wagering game players can be different. Accordingly, the wagering game player 1218 may or may not win similar awards as the wagering game player 1220 along the second path.

Figure 13:
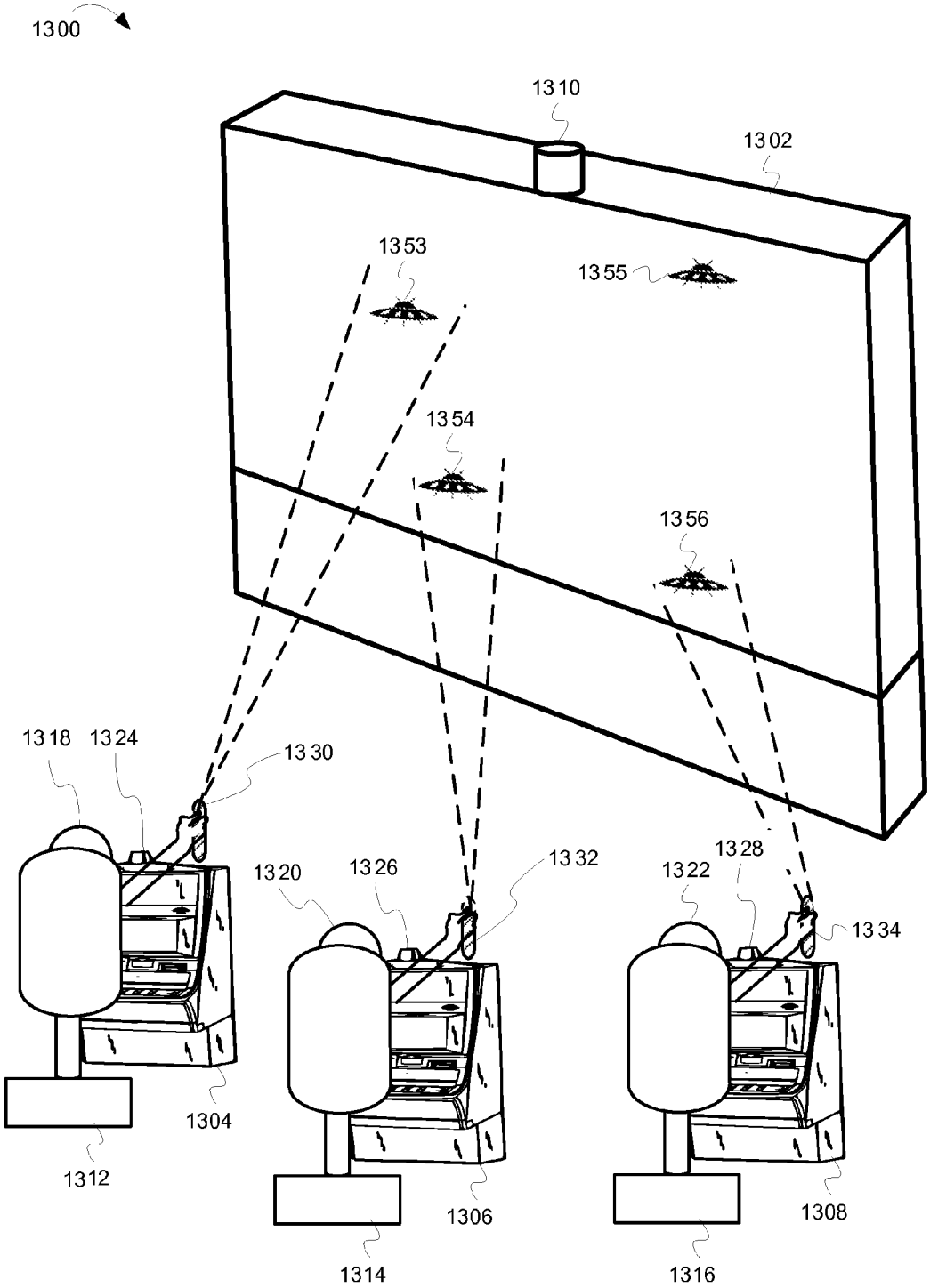
FIG. 13-14 depicts a wagering game system having a screen positioned in front of the community screen for presenting of images in front of the community screen, according to some example embodiments.
Figure 14:
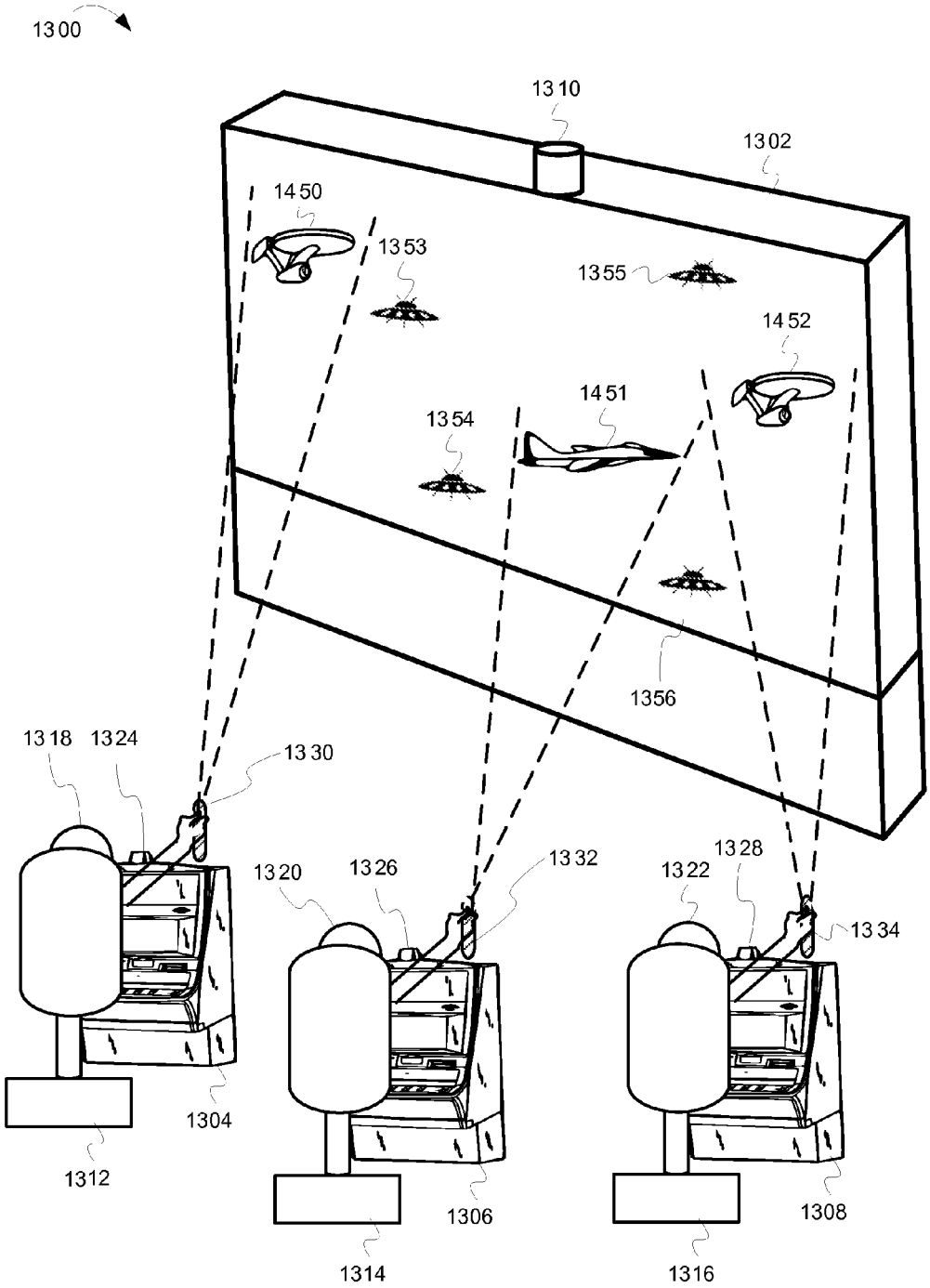

FIG. 13-14 depicts a wagering game system having a screen positioned in front of the community screen for presenting of images in front of the community screen, according to some example embodiments. In this example application, the handheld devices do not include displays through which the wagering game players can uniquely view the community event. Rather, based on the movement of the handheld devices, images are presented on a front screen located in front of the community screen. FIG. 13 displays the community event at a first point in time, and FIG. 14 displays the same community event at a different point in time. In particular, some graphic elements are not viewable at a first point in time (see FIG. 13) that then become viewable at a different point in time (see FIG. 14) based on where the handheld devices are being moved by the wagering game players. Also in contrast to the wagering game system 100 of FIG. 1, for a wagering game system 1300 of FIGS. 13-14, other players and persons can see what is being pointed to by a particular wagering game player using a handheld device.

FIGS. 13-14 depicts a wagering game system 1300 that includes a community screen 1302, a wagering game machine 1304, a wagering game machine 1306, and a wagering game machine 1308. Each of the wagering game machine 1304, the wagering game machine 1306, and the wagering game machine 1308 can include a wagering game module that is executed to provide communal game play (i.e., a community event) that is playable by wagering game players across the different wagering game machines 1304-1308. In this example, the community event includes the display of different space ships (further described below) on the community screen 1302. In some example embodiments, there is an image module within each wagering game machine that receives and processes the wireless transmissions received by the wireless receivers in the wagering game system 1300.

Also, the visual output from the communal event is displayed on the community screen 1302. Accordingly, the community screen 1302, and the wagering game machines 1304-1308 are communicatively coupled together. An example of a wagering game machine architecture having a wagering game module and an image module is illustrated in FIG. 17, which is described in more detail below. The wagering game system 1300 also includes a wireless emitter 1310 that is fixedly positioned to the community screen 1302. In this example, there is a single wireless emitter fixedly positioned to the community screen 1302. In some other example embodiments, the wireless emitter 1310 can be positioned at any other location on or near the community screen 1302 that can be used to determine movement of the handheld devices. Also in some other example embodiments, there can be multiple wireless emitters fixedly positioned on the community screen 1302 (e.g., opposite corners, all four corners, top and bottom, left and right, etc.).

In this example, seats are provided for each of the wagering game machines. A seat 1312 is positioned in front of the wagering game machine 1304. A seat 1314 is positioned in front of the wagering game machine 1306. A seat 1316 is positioned in front of the wagering game machine 1308. A wagering game player 1318 is seated in the seat 1312 in front of the wagering game machine 1304. A wagering game player 1320 is seated in the seat 1314 in front of the wagering game machine 1306. A wagering game player 1322 is seated in the seat 1316 in front of the wagering game machine 1308.

Each wagering game machine includes a handheld device. The wagering game machine 1304 includes a handheld device 1330. The wagering game machine 1306 includes a handheld device 1332. The wagering game machine 1308 includes a handheld device 1334.

The handheld device 1330 is communicatively coupled to the image module for the wagering game machine 1304. The handheld device 1332 is communicatively coupled to the image module for the wagering game machine 1306. The handheld device 1334 is communicatively coupled to the image module for the wagering game machine 1308. In some example embodiments, each of the handheld devices 1330-1334 includes a wireless receiver for receiving wireless transmissions from the wireless emitters (e.g., the wireless emitter 1310). In FIGS. 13-14, the wagering game player 1318, the wagering game player 1320, and the wagering game player 1322 are using their handheld devices—the handheld device 1330, the handheld device 1332, and the handheld device 1334, respectively—to provide input into the communal event that is being displayed on the community screen 1302.

In this example application shown in FIG. 13, spaceships 1353-1356 are shown as part of the community event. In FIG. 14, the spaceships 1353-1356 are also shown as part of the community event. Also in FIG. 14, spaceships 1450-1452 are shown as part of the community event. In this example, the spaceships 1450-1452 have been revealed on the front screen because the wagering game players are pointing their handheld devices to the locations where the spaceships 1450-1450 are on the community screen 1302. In particular, the wagering game player 1318 is pointing their handheld device 1330 at a location on the community screen 1302 to reveal the spaceship 1450. The wagering game player 1320 is pointing their handheld device 1332 at a location on the community screen 1302 to reveal the spaceship 1451. The wagering game player 1322 is pointing their handheld device 1334 at a location on the community screen 1302 to reveal the spaceship 1452. As shown, the spaceships 1450-1452 are not revealed at the first point in time shown in FIG. 13 because the wagering game players are not pointing their handheld devices to the locations of the spaceships 1450-1452.

The wireless transmissions can be captured and processed to determine what position is being pointed to by the wagering game player using the handheld device. Based on the position that is being pointed to on the community screen 1302, an image is presented on the front screen positioned in front of the community screen 1302. In some example embodiments, these images on the front screen comprise three dimensional images that are on top of the imagery of the community event.

Example Operations

This section describes operations associated with some example embodiments. In the discussion below, the flow charts will be described with reference to the block diagrams presented above. However, in some example embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 15:
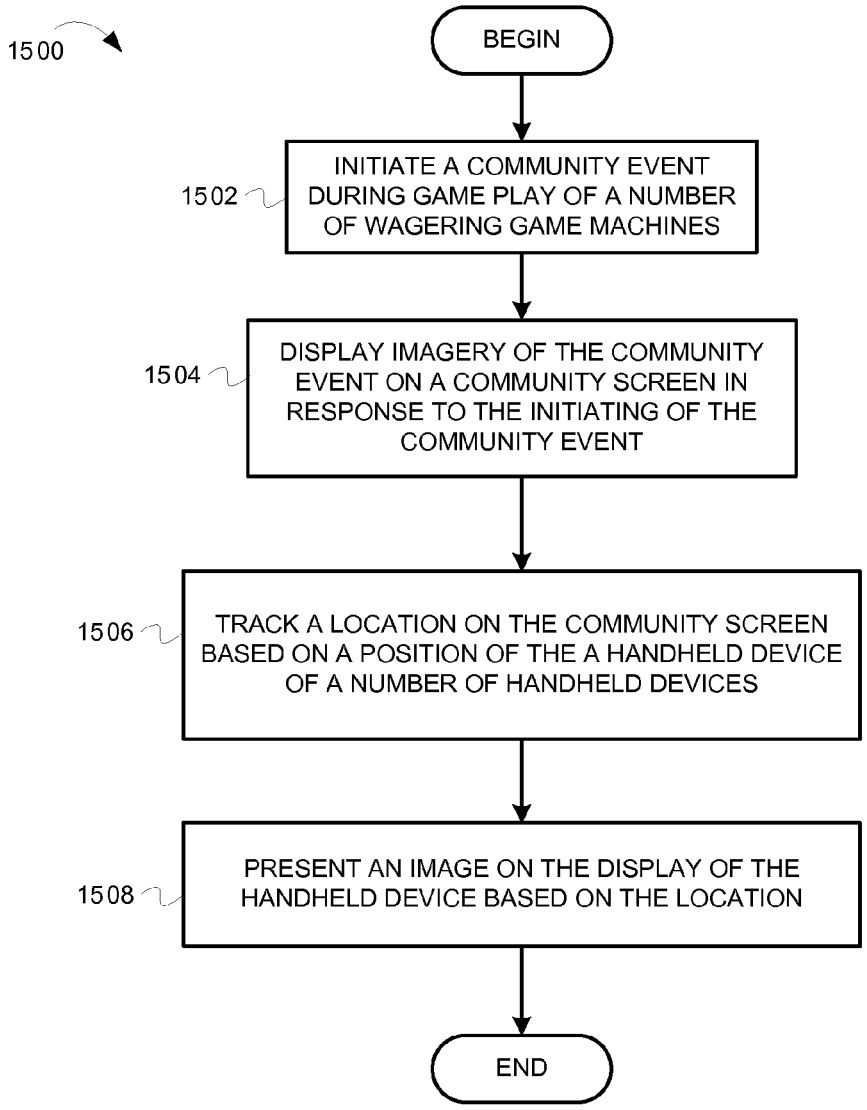
FIG. 15 depicts a flowchart of operations for using a handheld device used in a community event for providing a unique experience for a wagering game player, according to some example embodiments.
Figure 16:
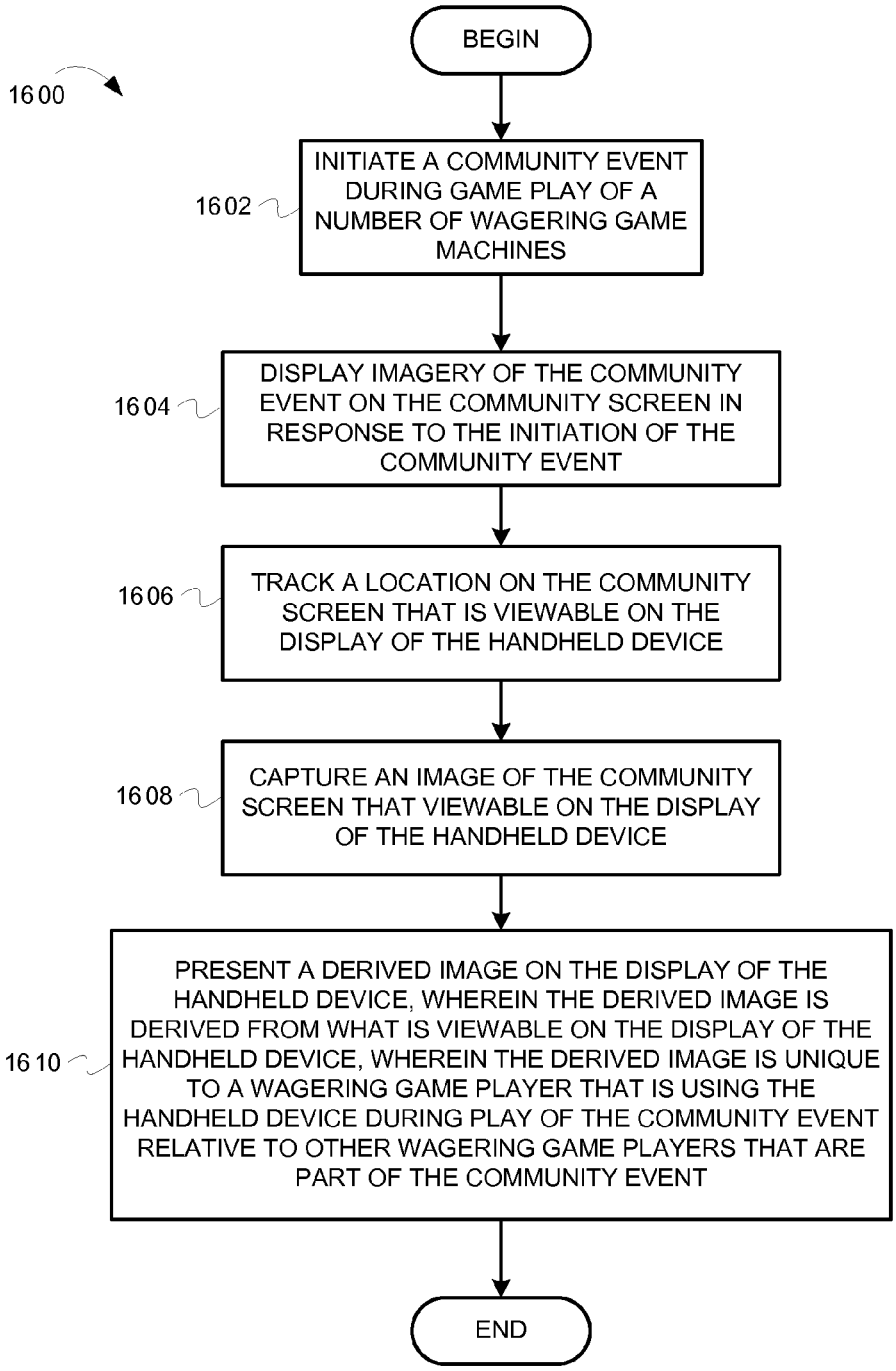
FIG. 16 depicts a flowchart of operations for using a handheld device having a camera for capturing parts of a community event for providing a unique experience for a wagering game player, according to some example embodiments.

The section will discuss FIGS. 15-16. The discussion of FIGS. 15-16 will describe operations for using handheld devices for community events of wagering games. The flowchart of FIG. 15 will describe operations performed for using a handheld device for a community event for providing a unique experience for a wagering game player. The flowchart of FIG. 16 will describe operations performed for using a handheld device having a camera for capturing parts of a community event for providing a unique experience for a wagering game player.

FIG. 15 depicts a flowchart of operations for using a handheld device for a community event for providing a unique experience for a wagering game player, according to some example embodiments. The operations of a flowchart 1500 are described in reference to FIG. 1. In some example embodiments, the operations are performed by the different components of the wagering game system 100 of FIG. 1. The operations of the flowchart 1500 begin at block 1502.

At block 1502, a wagering game module initiates a community event during game play of a number of wagering game machines. With reference to FIG. 1, the wagering game module initiates the community event during wagering by the wagering game players 118-122 at the wagering game machines 124-128, respectively. Operations of the flowchart 1500 continue at block 1504.

At block 1504, a wagering game module displays imagery of the community event on a community screen in response to the initiating of the community event. With reference to FIG. 1, the wagering game module displays different graphic images or elements as part of the community event on the community screen 102. Operations of the flowchart 1500 continue at block 1506.

At block 1506, an image module tracks a location on the community screen that is viewable on a display of a handheld device of a number of handheld devices. With reference to FIG. 1, the image module tracks the location based on the wireless transmissions and/or the facial images of the wagering game player using the handheld devices 130-134 (as described above). Operations of the flowchart 1500 continue at block 1508.

At block 1508, the image module presents an image on the display of the handheld device based on what is viewable on the display of the handheld device, wherein the image is unique to a wagering game player that is using the handheld device during play of the community event relative to other wagering game players that are part of the community event. With reference to FIG. 1, the image module presents images on the displays 170-174 of the handheld devices 130-134. Operations of the flowchart 1500 are complete.

FIG. 16 depicts a flowchart of operations for using a handheld device having a camera for capturing parts of a community event for providing a unique experience for a wagering game player, according to some example embodiments. The operations of a flowchart 1600 are described in reference to FIG. 1. In some example embodiments, the operations are performed by the different components of the wagering game system 100 of FIG. 1. The operations of the flowchart 1600 begin at block 1602.

At block 1602, a wagering game module initiates a community event during game play of a number of wagering game machines. With reference to FIG. 1, the wagering game module initiates the community event during wagering by the wagering game players 118-122 at the wagering game machines 124-128, respectively. Operations of the flowchart 1000 continue at block 1604.

At block 1604, a wagering game module displays imagery of the community event on a community screen in response to the initiating of the community event. With reference to FIG. 1, the wagering game module displays different graphic images or elements as part of the community event on the community screen 102. Operations of the flowchart 1600 continue at block 1606.

At block 1606, an image module tracks a location on the community screen that is viewable on a display of a handheld device of a number of handheld devices. With reference to FIG. 1, the image module tracks the location based on the wireless transmissions and/or the facial images of the wagering game player using the handheld devices 130-134 (as described above). Operations of the flowchart 1600 continue at block 1608.

At block 1608, the image module captures an image of the community screen that viewable on the display of the handheld device. With reference to FIG. 1, the image module captures an image of the community screen 102 that is viewable on the displays 170-174 of the handheld devices 130-134. The image can be captured using a camera that is part of the handheld device (as shown in FIG. 4). Operations of the flowchart 1600 continue at block 1610.

At block 1610, the image module presents a derived image on the display of the handheld device. The derived image can be derived from what is viewable on the display of the handheld device. Also, the image is unique to a wagering game player that is using the handheld device during play of the community event relative to other wagering game players that are part of the community event. With reference to FIG. 1, the image module displays these derived images on the displays 170-172 of the handheld devices 130-134. Operations of the flowchart 1600 are complete.

Wagering Game Machine Architecture and Network Environment

This section describes an example wagering game architecture and network environment of some example embodiments.

Wagering Game Machine Architecture

FIG. 17 is a block diagram illustrating a wagering game machine architecture, according to some example embodiments. The gaming terminal 1710 includes a central processing unit (CPU) 1730 connected to a main memory 1732. The CPU 1730 may include any suitable processor(s), such as those made by Intel and AMD. By way of example, the CPU 1730 includes a plurality of microprocessors including a master processor, a slave processor, and a secondary or parallel processor. CPU 1730, as used herein, comprises any combination of hardware, software, or firmware disposed in or outside of the gaming terminal 1710 that is configured to communicate with or control the transfer of data between the gaming terminal 1710 and a bus, another computer, processor, device, service, or network. The CPU 1730 comprises one or more controllers or processors and such one or more controllers or processors need not be disposed proximal to one another and may be located in different devices or in different locations. The CPU 1730 is operable to execute all of the various gaming methods and other processes disclosed herein. The main memory 1728 includes a wagering game module 1732 and an image module 1732. In one embodiment, the wagering game module 1732 may present wagering games, such as video poker, video blackjack, video slots, video lottery, etc., in whole or part. In some example embodiments, the image module 1736 performs the operations for presenting images (as described above).

The CPU 1730 is also connected to an input/output (I/O) bus 1736, which can include any suitable bus technologies, such as an AGTL+ frontside bus and a PCI backside bus. The I/O bus 1736 is connected to various input devices 1738, output devices 1740, and input/output devices 1742. The I/O bus 1736 is also connected to storage unit 1744 and external system interface 1746, which is connected to external system(s) 1748 (e.g., wagering game networks).

The external system 1748 includes, in various aspects, a gaming network, other gaming terminals, a gaming server, a remote controller, communications hardware, or a variety of other interfaced systems or components, in any combination. In yet other aspects, the external system 1748 may comprise a player's portable electronic device (e.g., cellular phone, electronic wallet, etc.) and the external system interface 1746 is configured to facilitate wireless communication and data transfer between the portable electronic device and the CPU 1730, such as by a near-field communication path operating via magnetic-field induction or a frequency-hopping spread spectrum RF signals (e.g., Bluetooth, etc.).

The gaming terminal 1710 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 1748 ("thin client" gaming terminal), or are distributed therebetween in any suitable manner ("intermediate client" gaming terminal).

Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 18:
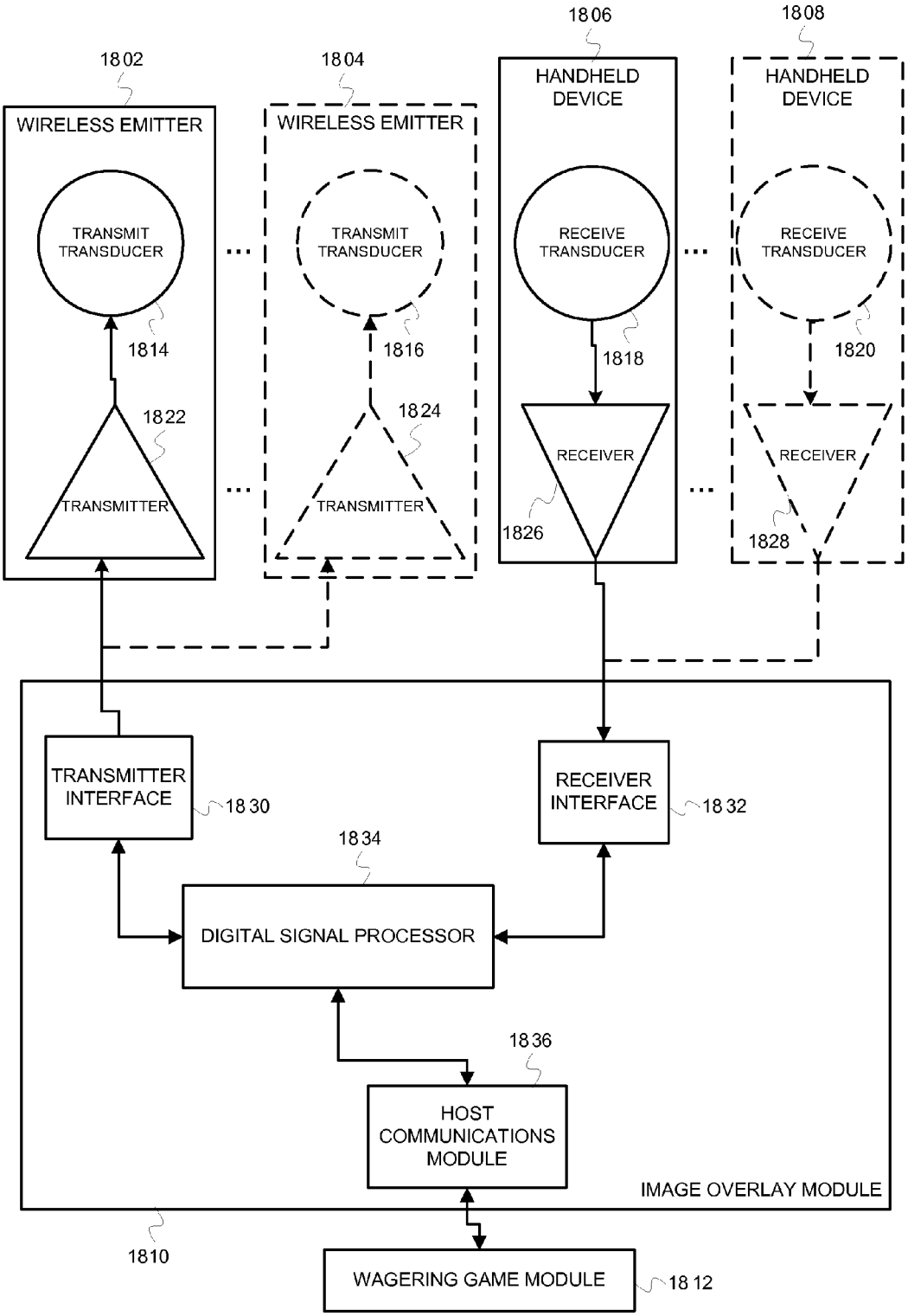
FIG. 18 depicts a more detailed block diagram of parts of the handheld devices and the image module, according to some example embodiments.

FIG. 18 depicts a more detailed block diagram of parts of the handheld devices and the image module, according to some example embodiments. FIG. 18 depicts an example configuration of the coupling of the handheld devices, wireless emitters, the position module and the wagering game module. FIG. 18 includes a number of wireless emitters (shown as wireless emitters 1802-1804) and a number of handheld devices (shown as handheld devices 1806-1808). FIG. 18 also includes an image module 1810 and a wagering game module 1812.

The wireless emitter 1802 includes a transmit transducer 1814 and a transmitter 1822 that are communicatively coupled together. The wireless emitter 1804 includes a transmit transducer 1816 and a transmitter 1824 that are communicatively coupled together. The handheld device 1806 includes a receive transducer 1818 and a receiver 1826 that are communicatively coupled together. The handheld device 1808 includes a receive transducer 1820 and a receiver 1828 that are communicatively coupled together.

The image module 1810 includes a transmitter interface 1830, a receiver interface 1832, a digital signal processor 1834, and a host communications module 1836. The transmitter interface 1830 and the receiver interface 1832 are communicatively coupled to the digital signal processor 1834. The image module 1810 also includes a host communications module 1836. The host communications module 1836 is communicatively coupled to the wagering game module 1812.

The image module 1810 can be located in any component in a wagering game system. For example, the image module 1810 can be in one of the wagering game machine, in each wagering game machine, in the community screen, etc. Also, in this example, the receive transducers are within the handheld devices. However, as described above, the handheld devices can transmit (instead of receive) the wireless transmissions. Accordingly, in such an example, the handheld devices would include the transmit transducers and transmitters, and wireless receivers would replace the wireless emitters and include the receive transducers and receivers.

During operation, the digital signal processor 1834 performs analog-to-digital conversion and digital-to-analog conversion. For example, the receive transducers 1818-1820 can capture the wireless transmissions (as described above). The receive transducers 1818-1820 can transmit this analog data to the receivers 1826-1828. The receivers 1826-1828 can then transmit this analog data to the digital signal processor 1834 through the receiver interface 1832. The digital signal processor 1834 can then convert this analog data into digital data and then forward this digital data to the host communications module 1836. The digital signal processor 1834 can also determine the content that is viewable through the displays of the handheld devices (as described above). The host communications module 1836 can then forward this data to the wagering game module 1812.

Also, during operation, the wagering game module 1812 can provide data to the digital signal processor 1834 through the host communications module 1836. The digital signal processor 1834 can then convert this data into analog data that is forwarded to the transmitters 1822-1824 through the transmitter interface 1830. The transmitters can forward this analog data to the transmit transducers 1814-1816 to cause the transmit transducers to emit the wireless transmissions, as described above.

Wagering Game Network

Figure 19:
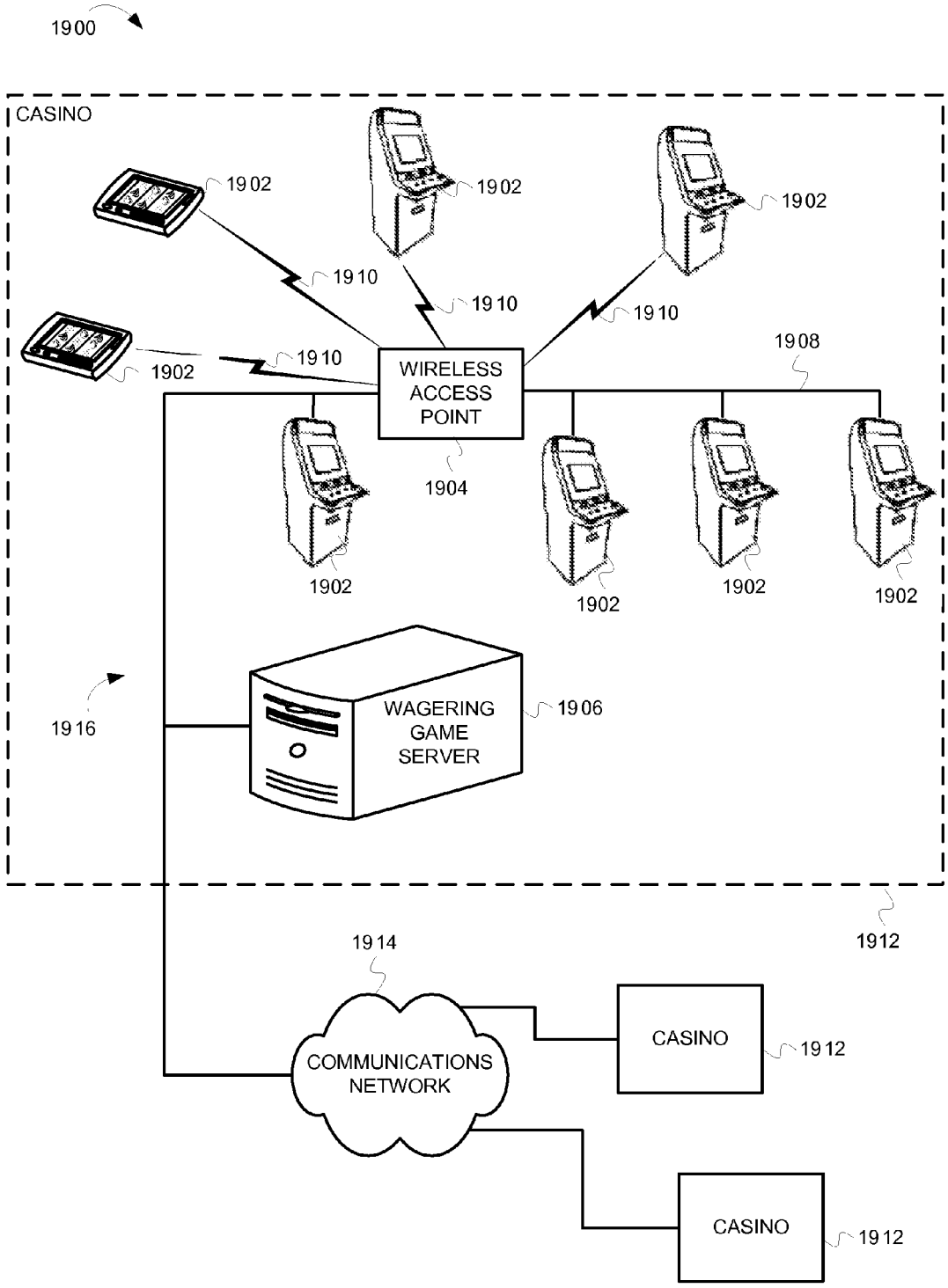
FIG. 19 is a block diagram illustrating a wagering game network, according to some example embodiments.

FIG. 19 is a block diagram illustrating a wagering game network 1900, according to some example embodiments. As shown in FIG. 19, the wagering game network 1900 includes a plurality of casinos 1912 connected to a communications network 1914.

Each casino 1912 includes a local area network 1916, which includes an access point 1904, a wagering game server 1906, and wagering game machines 1902. The access point 1904 provides wireless communication links 1910 and wired communication links 1908. The wired and wireless communication links can employ any suitable connection technology, such as Bluetooth, 802.11, Ethernet, public switched telephone networks, SONET, etc. In some embodiments, the wagering game server 1906 can serve wagering games and distribute content to devices located in other casinos 1912 or at other locations on the communications network 1914.

The wagering game machines 1902 described herein can take any suitable form, such as floor standing models, handheld mobile units, bartop models, workstation-type console models, etc. Further, the wagering game machines 1902 can be primarily dedicated for use in conducting wagering games, or can include non-dedicated devices, such as mobile phones, personal digital assistants, personal computers, etc. In one embodiment, the wagering game network 1900 can include other network devices, such as accounting servers, wide area progressive servers, player tracking servers, and/or other devices suitable for use in connection with embodiments of the invention.

In some embodiments, wagering game machines 1902 and wagering game servers 1906 work together such that a wagering game machine 1902 can be operated as a thin, thick, or intermediate client. For example, one or more elements of game play may be controlled by the wagering game machine 1902 (client) or the wagering game server 1906 (server). Game play elements can include executable game code, lookup tables, configuration files, game outcome, audio or visual representations of the game, game assets or the like. In a thin-client example, the wagering game server 1906 can perform functions such as determining game outcome or managing assets, while the wagering game machine 1902 can present a graphical representation of such outcome or asset modification to the user (e.g., player). In a thick-client example, the wagering game machines 1902 can determine game outcomes and communicate the outcomes to the wagering game server 1906 for recording or managing a player's account. In some example embodiments, the wagering game machines 1902 can have handheld devices and can be part of communal event (as described above).

In some embodiments, either the wagering game machines 1902 (client) or the wagering game server 1906 can provide functionality that is not directly related to game play. For example, account transactions and account rules may be managed centrally (e.g., by the wagering game server 1906) or locally (e.g., by the wagering game machine 1902). Other functionality not directly related to game play may include power management, presentation of advertising, software or firmware updates, system quality or security checks, etc.

Any of the wagering game network components (e.g., the wagering game machines 1902) can include hardware and machine-readable media including instructions for performing the operations described herein.

Example Wagering Game Machine

Figure 20:
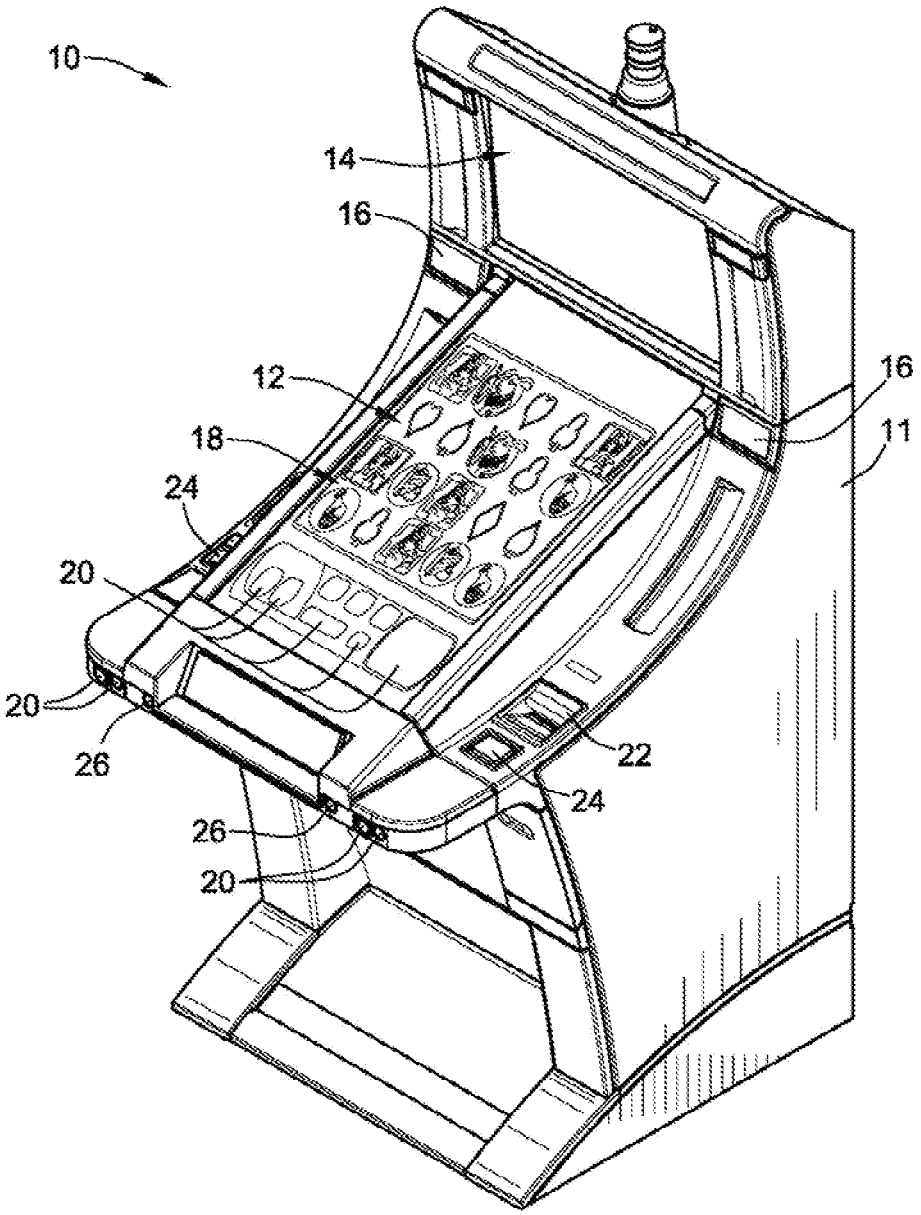
FIG. 20 is a perspective view of a wagering game machine, according to some example embodiments.

FIG. 20 is a perspective view of a wagering game machine, according to some example embodiments. Referring to FIG. 20, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0062196 and US2010/0234099, which are incorporated herein by reference in their entireties.

The gaming terminal 10 illustrated in FIG. 20 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 21:
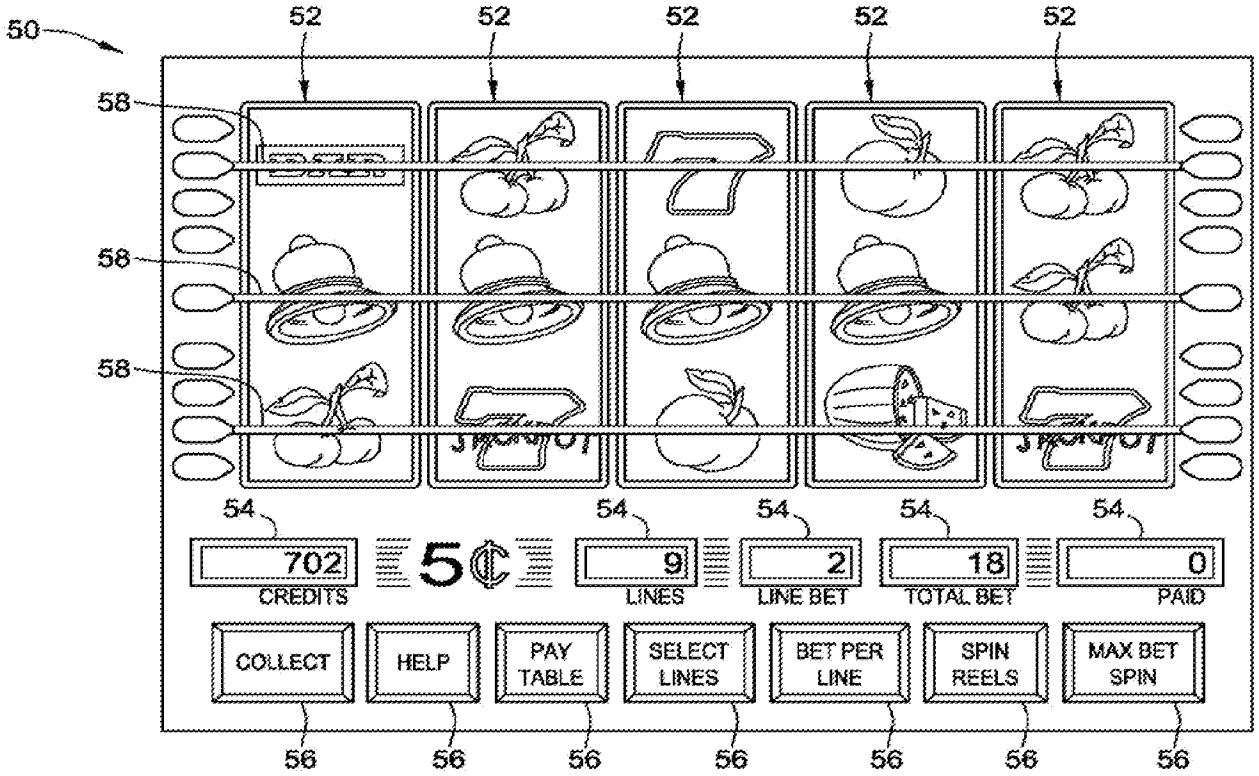
FIG. 21 depicts an image of a base-game screen for a wagering game machine, according to some example embodiments.

FIG. 21 depicts an image of a base-game screen for a wagering game machine, according to some example embodiments. Referring to FIG. 21, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 20. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 20, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 1230) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 1244), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A system comprising:

a community screen configured to display images of a community event thereon;

a number of wagering game machines communicatively coupled to the community screen;

a number of handheld devices, each handheld device having a respective display and being communicatively coupled to respective one of the wagering game machines; and an image module configured, for at least one handheld device of the number of handheld devices, to:

identify a location on the community screen based on a position of the at least one handheld device; and present an image on the display of the at least one handheld device based on the location, wherein the image indicates one or more of an effect on wagering game play on the respective one of the wagering game machines, an effect on the community event, or an award provided for play of the community event.

2. The system of claim 1, wherein the image module is configured to present the image on the display of the at least one handheld device that is unique to a wagering game player that is using the at least one handheld device during play of the community event relative to other wagering game players that are part of the community event.

3. The system of claim 1, the image module further configured to:

modify, based on movement of the at least one handled device, the image on the display to compensate for the movement of the at least one handled device.

4. The system of claim 1, wherein the display of each handheld device comprises a transmissive display on which the image is presented.

5. The system of claim 1, wherein the display of each handheld device comprises a non-transmissive display on which the image is presented, wherein each handheld device comprises a camera configured to capture the location of the community screen, and wherein the image module is configured to derive the image based on the captured location.

6. The system of claim 1, wherein each of the handheld devices is configured to present an image on the display of the handheld device based on at least one of play of the community event and wagering game play at the associated wagering game machine.

7. The system of claim 1, wherein each handheld device comprises a camera configured to capture a face image of a face of a respective wagering game player that is using the handheld device during play of the community event, wherein the image module is configured to determine a direction that the face of the respective wagering game player is facing based on the face image, and wherein the image module is configured to identify the location based on the direction that the face of the respective wagering game player is facing.

8. A method comprising:

initiating a community event during game play at a number of wagering game machines;

displaying imagery of the community event on a community screen;

identifying a location on the community screen based on a position of a handheld device of a number of handheld devices, each handheld device being communicatively coupled to a respective one of the number of wagering game machines; and presenting an image on the display of the handheld device based on the location, wherein the image indicates one or more of an effect on wagering game play on the respective one of the number of wagering game machines, an effect on the community event, or an award provided for play of the community event.

9. The method of claim 8, further comprising, prior to presenting the image, receiving a selection from a wagering game player via an input on the handheld device to select a graphic element displayed at the location on the community screen, wherein the image that is presented is associated with the graphic element.

10. The method of claim 8, further comprising:

modifying, based on movement of the handheld device, the image on the display of the handheld device to compensate for the movement of the handheld device.

11. The method of claim 8, wherein the display of the handheld device comprises a transmissive display on which the image is presented.

12. The method of claim 8, wherein the display of the handheld device comprises a non-transmissive display on which the image is presented and wherein the handheld device comprises a camera, wherein the method comprises:

capturing, using the camera, the location of the community screen;

deriving the image based on the captured location.

13. An apparatus comprising:

a handheld device having a display;

at least one display device including a community screen;

at least one processor;

at least one memory device configured to store instructions that, when executed by the at least one processor, cause the apparatus to:

initiate a community event during game play at a number of wagering game machines;

display imagery of the community event on the community screen;

capture an image of the community screen based on a position of the handheld device;

derive a presented image based on the image that is captured; and display the presented image on the display of the handheld device, wherein the presented image one or more of indicates an effect on wagering game play on at least one of the number of wagering game machines, an effect on the community event, or an award provided for play of the community event.

14. The apparatus of claim 13, wherein the handheld device comprises a button, wherein, prior to presenting the image, the apparatus is configured to receive a selection from the wagering game player via the button on the handheld device to select a graphic element displayed at the location on the community screen, wherein the image that is presented is associated with the graphic element.

15. The apparatus of claim 13, the instructions further causing instructions to cause the apparatus to:

modify, based on movement of the handheld device, the presented image to compensate for the movement of the handheld device.

16. The apparatus of claim 13, wherein the display of the handheld device comprises a transmissive display.

17. The apparatus of claim 13, wherein the handheld device comprises a camera configured to capture a face image of a face of the wagering game player that is using the handheld device during play of the community event, wherein the apparatus is configured to determine a direction that the face of the wagering game player is facing based on the face image, and wherein the apparatus is configured to determine the position of the handheld device based on the direction that the face of the wagering game player is facing.

18. One or more machine-readable storage media including instructions which, when executed by one or more processors, cause the one or more processors to perform operations comprising:

initiate a community event during game play at a number of wagering game machines;

display imagery of the community event on a community screen;

identify a location on the community screen based on a position of a handheld device of a number of handheld devices, each handheld device being communicatively coupled to a respective one of the number of wagering game machines; and present an image on the display of the handheld device based on the location, wherein the image indicates one or more of an effect on wagering game play on the respective one of the number of wagering game machines, an effect on the community event, or an award provided for play of the community event.

19. The one or more machine-readable storage media of claim 18, wherein the operations comprise, prior to presenting the image, receiving a selection from a wagering game player via an input on the handheld device to select a graphic element displayed at the location on the community screen, wherein the image that is presented is associated with the graphic element.

20. The one or more machine-readable storage media of claim 18, the operations further comprising:

modify, based on movement of the handheld device, the image on the display to compensate for the movement of the handheld device.

21. The one or more machine-readable storage media of claim 18, wherein the display of the handheld device comprises a transmissive display.

22. The one or more machine-readable storage media of claim 18, wherein the display of the handheld device comprises a non-transmissive display on which the image is presented and wherein the handheld device comprises a camera, wherein the operations comprise:

capture, using the camera, the location of the community screen; and derive the image based on the captured location.

23. An apparatus comprising:

means for initiating a community event during game play at a number of wagering game machines;

means for displaying imagery of the community event on a community screen;

means for identifying a location on the community screen based on a position of a handheld device of a number of handheld devices, each handheld device being communicatively coupled to a respective one of the number of wagering game machines; and means for presenting an image on the display of the handheld device based on the location, wherein the image indicates one or more of an effect on wagering game play on the respective one of the number of wagering game machines, an effect on the community event, or an award provided for play of the community event.

24. The apparatus of claim 23, further comprising means for receiving a selection from a wagering game player via an input on the handheld device to select a graphic element displayed at the location on the community screen, wherein the image that is presented is associated with the graphic element.

25. The apparatus of claim 23, further comprising:

means for modifying, based on movement of the handheld device, the image on the display to compensate for the movement of the handheld device.

* * * * *